US012778367B2

(12) United States Patent
Ohm et al.

(10) Patent No.: US 12,778,367 B2
(45) **Date of Patent: *Nov. 3, 2026**

(54) MOBILE CLEANING ROBOT WITH ADJUSTABLE SUSPENSION

(71) Applicant: iRobot Corporation, Bedford, MA (US)

(72) Inventors: Timothy R. Ohm, Grover Beach, CA (US); Erik Edward Steltz, Melrose, MA (US); Russell Walter Morin, Burlington, MA (US); Fangzheng Guo, Arlington, MA (US)

(73) Assignee: iRobot Corporation, Bedford, MA (US)

( * ) Notice: Subject to any disclaimer, the term of this patent is extended or adjusted under 35 U.S.C. 154(b) by 89 days.

This patent is subject to a terminal disclaimer.

(21) Appl. No.: 18/820,382

(22) Filed: Aug. 30, 2024

(65) Prior Publication Data

US 2024/0423429 A1 Dec. 26, 2024

Related U.S. Application Data

(63) Continuation of application No. 18/216,763, filed on Jun. 30, 2023, now Pat. No. 12,082,764, which is a (Continued)

(51) Int. Cl.
*A47L 9/06* (2006.01)
*A47L 7/00* (2006.01)
(Continued)

(52) U.S. Cl.
CPC ..... *A47L 9/066* (2013.01); *A47L 7/009* (2013.01); *A47L 9/009* (2013.01); *A47L 9/2847* (2013.01);
(Continued)

(58) Field of Classification Search
CPC . A47L 9/06; A47L 9/066; A47L 9/009; A47L 9/2847; A47L 9/2852; A47L 7/00;
(Continued)

(56) References Cited

U.S. PATENT DOCUMENTS 11,857,139 B2 1/2024 Ohm et al.
12,532,996 B2 1/2026 Ohm
(Continued)

FOREIGN PATENT DOCUMENTS

CN 112140025 A * 12/2020 ..... B25B 11/00
CN 112847383 A 5/2021
(Continued)

OTHER PUBLICATIONS

English translation of KR 20080028220A (Year: 2008).*
(Continued)

*Primary Examiner* — David S Posigian
*Assistant Examiner* — Sukwoo James Chang
(74) *Attorney, Agent, or Firm* — MASCHOFF BRENNAN

(57) ABSTRACT

A mobile cleaning robot can include a body, a drive wheel, and a wheel stop. The drive wheel can be connected to the body and can be operable to move the mobile cleaning robot about an environment. The wheel stop can be movable with respect to the body and the drive wheel between a stop position and a release position. The wheel stop can be engageable with the drive wheel in the stop position to limit vertical travel of the drive wheel with respect to the body.

20 Claims, 30 Drawing Sheets

Related U.S. Application Data continuation of application No. 17/388,307, filed on Jul. 29, 2021, now Pat. No. 11,857,139.

(51) Int. Cl.

| | |
|---|---|
| ***A47L 9/00*** | (2006.01) |
| ***A47L 9/28*** | (2006.01) |
| ***A47L 11/28*** | (2006.01) |
| ***A47L 11/40*** | (2006.01) |

(52) U.S. Cl.

CPC ..... *A47L 9/2852* (2013.01); *A47L 11/28* (2013.01); *A47L 11/4011* (2013.01); *A47L 11/4036* (2013.01); *A47L 11/4055* (2013.01); *A47L 11/4061* (2013.01); *A47L 11/4063* (2013.01); *A47L 11/4066* (2013.01); *A47L 11/4072* (2013.01); *A47L 2201/04* (2013.01); *A47L 2201/06* (2013.01)

(58) Field of Classification Search

CPC ..... A47L 7/009; A47L 11/28; A47L 11/4011; A47L 11/4036; A47L 11/4055; A47L 11/4061; A47L 11/4063; A47L 11/4066; A47L 11/4072; A47L 11/4058; A47L 11/4069; A47L 11/40; A47L 11/4044; A47L 2201/00; A47L 2201/04; A47L 2201/06

See application file for complete search history.

(56) References Cited

U.S. PATENT DOCUMENTS

| | | | | |
|---|---|---|---|---|
| 2008/0265490 | A1 | 10/2008 | Hendrix et al. | |
| 2013/0340201 | A1* | 12/2013 | Jang | A47L 9/009 15/300.1 |
| 2020/0000302 | A1 | 1/2020 | Morin et al. | |
| 2020/0238836 | A1 | 7/2020 | Cheng et al. | |
| 2022/0370160 | A1 | 11/2022 | Basafa et al. | |
| 2023/0032691 | A1 | 2/2023 | Ohm et al. | |
| 2023/0346182 | A1 | 11/2023 | Ohm et al. | |

FOREIGN PATENT DOCUMENTS

| | | | | |
|---|---|---|---|---|
| CN | 218832658 | U | 4/2023 | |
| CN | 218943204 | U | 5/2023 | |
| CN | 219206721 | U | 6/2023 | |
| CN | 219206722 | U | 6/2023 | |
| DE | 102014213121 | A1 * | 1/2016 | B60G 17/005 |
| EP | 2433541 | A1 | 3/2012 | |
| EP | 2476570 | A2 | 7/2012 | |
| JP | 2014176509 | A * | 9/2014 | A47L 9/28 |
| KR | 20040096253 | A | 11/2004 | |
| KR | 20080028220 | A * | 3/2008 | A47L 9/2884 |
| WO | WO-2019164261 | A1 | 8/2019 | |
| WO | WO-2023009299 | A1 | 2/2023 | |

OTHER PUBLICATIONS

English translation of CN 112140025A (Year: 2020).*
English translation of DE 102014213121A1 (Year: 2016).*
English translation of JP 2014176509A (Year: 2014).*
U.S. Appl. No. 17/388,307 U.S. Pat. No. 11,857,139, filed Jul. 29, 2021, Mobile Cleaning Robot With Adjustable Suspension.
U.S. Appl. No. 18/216,763 U.S. Pat. No. 12,082,764, filed Jun. 30, 2023, Mobile Cleaning Robot With Adjustable Suspension.
U.S. Appl. No. 18/139,014, filed Apr. 25, 2023, Mobile Cleaning Robot With Active Suspension.
"International Application Serial No. PCT US2024 014753, International Preliminary Report on Patentability mailed Nov. 6, 2025", 11 pgs.
"U.S. Appl. No. 18/139,014, Response filed Nov. 17, 2025 to Final Office Action mailed Sep. 17, 2025", 10 pgs.
"U.S. Appl. No. 18/139,014, Response filed Sep. 4, 2025 to Non Final Office Action mailed Jun. 4, 2025", 11 pgs.
"U.S. Appl. No. 18/139,014, Final Office Action mailed Sep. 17, 2025", 8 pgs.
"U.S. Appl. No. 17/388,307, Non Final Office Action mailed Jan. 20, 2023", 16 pgs.
"U.S. Appl. No. 17/388,307, Notice of Allowance mailed May 4, 2023", 12 pgs.
"U.S. Appl. No. 17/388,307, Response filed Feb. 22, 2023 to Non Final Office Action mailed Jan. 20, 2023", 10 pgs.
"U.S. Appl. No. 18/216,763, Corrected Notice of Allowability mailed Jul. 24, 2024", 2 pgs.
"U.S. Appl. No. 18/216,763, Non Final Office Action mailed Mar. 1, 2024", 16 pgs.
"U.S. Appl. No. 18/216,763, Notice of Allowance mailed Jul. 1, 2024", 11 pgs.
"U.S. Appl. No. 18/216,763, Response filed May 30, 2024 to Non Final Office Action mailed Mar. 1, 2024", 9 pgs.
"Chinese Application Serial No. 202221973060.8, Notification to Make Rectification mailed Jan. 9, 2023", w/o English Translation, 2 pgs.
"Chinese Application Serial No. 202221973060.8, Response filed Mar. 9, 2023 to Notification to Make Rectification mailed Jan. 9, 2023", w/out English claims, 24 pgs.
"Chinese Application Serial No. 202221973144.1, Notification to Make Rectification mailed Nov. 23, 2022", w/o English Translation, 1 pg.
"Chinese Application Serial No. 202221973144.1, Response filed Feb. 8, 2023 to Notification to Make Rectification mailed Nov. 23, 2022", w/ English Claims, 31 pgs.
"Chinese Application Serial No. 202221973157.9, Office Action mailed Dec. 19, 2022", w/ Concise Statement of Relevance, 3 pgs.
"Chinese Application Serial No. 202221973157.9, Response filed Feb. 28, 2023 to Office Action mailed Dec. 19, 2022", w/o English Claims, 26 pgs.
"Chinese Application Serial No. 202221973217.7, Office Action mailed Dec. 19, 2022", W/ Concise Statement of Relevance, 3 pg.
"Chinese Application Serial No. 202221973217.7, Response filed Feb. 28, 2023 to Office Action mailed Dec. 19, 2022", w/out English claims, 26 pgs.
"English Translation of CN 112847383A", (20121), 7 pgs.
"English Translation of KR 20080028220A", (2008), 4 pgs.
"International Application Serial No. PCT/US2022/036636, International Preliminary Report on Patentability mailed Feb. 8, 2024", 8 pgs.
"International Application Serial No. PCT/US2022/036636, International Search Report mailed Nov. 8, 2022", 4 pgs.
"International Application Serial No. PCT/US2022/036636, Written Opinion mailed Nov. 8, 2022", 6 pgs.
"International Application Serial No. PCT/US2024/014753, International Search Report mailed Aug. 30, 2024", 6 pgs.
"International Application Serial No. PCT/US2024/014753, Invitation to Pay Additional Fees mailed Jul. 8, 2024", 4 pgs.
"International Application Serial No. PCT/US2024/014753, Written Opinion mailed Aug. 30, 2024", 9 pgs.
"U.S. Appl. No. 18/139,014, Non Final Office Action mailed Jun. 4, 2025", 13 pgs.
"U.S. Appl. No. 18/139,014, Notice of Allowance mailed Dec. 9, 2025", 5 pgs.

* cited by examiner

MOBILE CLEANING ROBOT WITH ADJUSTABLE SUSPENSION

PRIORITY APPLICATIONS

This application is a continuation of U.S. patent application Ser. No. 18/216,763, filed Jun. 30, 2023, which application is a continuation of U.S. patent application Ser. No. 17/388,307, filed Jul. 29, 2021, which issued on Jan. 2, 2024 as U.S. Pat. No. 11,857,139, the content of which is incorporated herein by reference in its entirety.

BACKGROUND

Autonomous mobile robots include autonomous mobile cleaning robots that can autonomously perform cleaning tasks within an environment, such as a home. An autonomous cleaning robot can navigate across a floor surface and avoid obstacles while vacuuming the floor surface and operating rotatable members carried by the robot to ingest debris from the floor surface. As the robot moves across the floor surface, the robot can rotate the rotatable members, which can engage the debris and guide the debris toward a vacuum airflow generated by the robot. The rotatable members and the vacuum airflow can thereby cooperate to allow the robot to ingest debris.

SUMMARY

Certain mobile cleaning robots can perform both mopping and vacuuming operations, where a cleaning pad can be added to the bottom of the mobile cleaning robot and dragged behind the vacuuming elements of the robotic vacuum. In such systems, it may be difficult to provide an appropriate amount of weight on the cleaning pad and also provide adequate contact between the cleaning head and the floor, such as due to tolerance stacking of components of the robot. For example, due to variance in manufacturing, in some robots, the weight of the robot may principally be on the caster and the two wheels, with not much weight on the pad. In such a situation, the cleaning efficiency of the pad would be compromised. In another example, again due to variance in manufacturing, the robot weight may be principally on the caster and the pad, with a potentially too large of a weight on the pad, which can reduce mobility of the robot because the pad becomes difficult to push or pull along the floor.

To help address the problems described above, this disclosure discusses solutions including adjusting the robot suspension responsive to the operating mode (e.g., mopping mode or vacuuming mode) of the robot to provide more reliable and better cleaning. For example, by adjusting the robot suspension during the mopping mode, a defined amount of weight can be placed upon the cleaning pad to allow for more effective cleaning. And when vacuuming, the suspension can be adjusted to provide good contact between the ground and the cleaning head to provide improved debris pickup.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
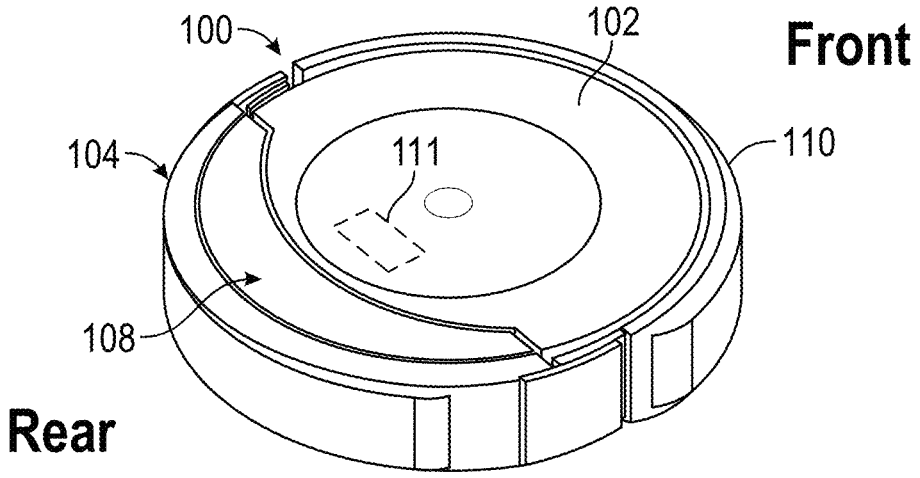
FIG. 1A illustrates an isometric view of a mobile cleaning robot in a first condition.

Two-in-one mobile cleaning robots can include a retractable or movable mopping pad to allow the robot to perform only vacuuming operations or to perform vacuuming and mopping operations. Optionally, only mopping operations can be performed. Regardless of performance mode options, in two-in-one mobile cleaning robots, the mopping pad can be moved between a stored position and an extended or mopping position. This versatility can help to improve vacuuming operation effectiveness and mobility when the pad is stored and can allow for the robot to store the pad for vacuuming of surfaces that cannot or should not be mopped (e.g., carpet). However, when the pad is in the mopping or cleaning position, the dynamics of the robot suspension are changed due to the pad's engagement with the ground because forces must be applied to the pad for effective mopping, which can cause forces applied to other components, such as a drive wheel, to be reduced. As such, it is desirable to alter the suspension of the robot depending on the operating mode (mopping or vacuuming) of the robot and position of the cleaning pad assembly.

This disclosure helps to address this issue by including an adjustable suspension system in a mobile cleaning robot. For example, a mobile cleaning robot can include a body, a drive wheel, and a wheel stop. The drive wheel can be connected to the body and can be operable to move the mobile cleaning robot about an environment. The wheel stop can be movable with respect to the body and the drive wheel between a stop position and a release position. The wheel stop can be engageable with the drive wheel in the stop position to help distribute force to the drive wheels in the vacuuming mode, which can help to ensure load applied through the cleaning head is in a good operating range. When the wheel stop is in the stop position when the robot is in a vacuuming mode, a caster or skid carries a portion of the weight of the robot and the wheels carry a relatively high percentage of the weight such that hard stops or wheel stops are used to limit wheel travel with respect to the body and are used to set the height of the robot precisely so that the cleaning head is engaged with the floor with the right amount of force. However, when the pad is moved to a deployed position, force must be applied by the pad to the floor surface for cleaning effectiveness of the pad. This means the optimized load distributed through the wheels is not the same as in the vacuuming mode, and the wheel travel in the mopping mode can be relatively larger than the vacuuming mode. To address these issues, in the mopping mode, the wheel stop can be moved such that the fender is engageable with a chassis (or skid or other object) to transfer load of the robot rearward to help increase a force applied by the mopping pad on the floor surface. Such a movable wheel stop can allow for improved suspension performance, cleaning performance, and mobility in multiple operating or cleaning modes.

The above discussion is intended to provide an overview of subject matter of the present patent application. It is not intended to provide an exclusive or exhaustive explanation of the invention. The description below is included to provide further information about the present patent application.

Figure 1B:
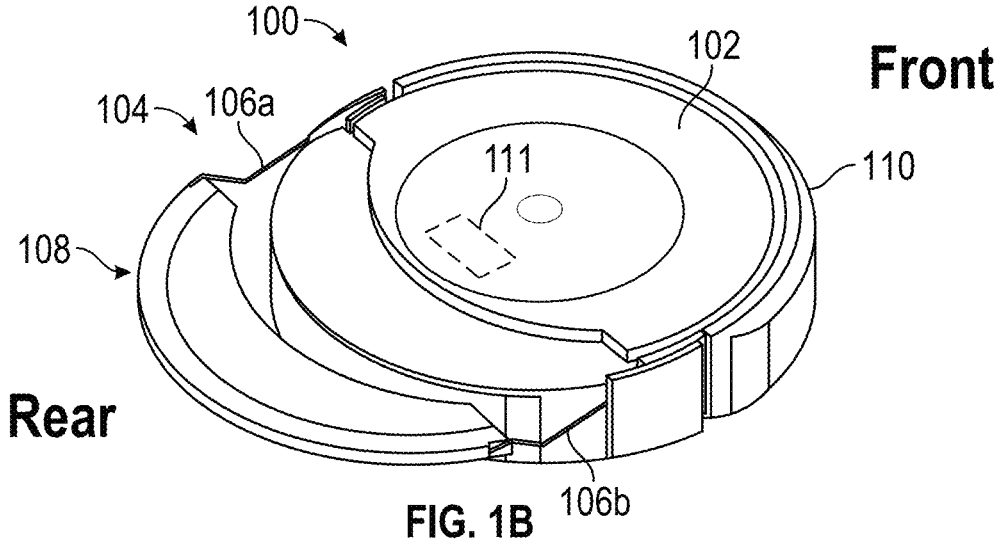
FIG. 1B illustrates an isometric view of a mobile cleaning robot in a second condition.
Figure 1C:
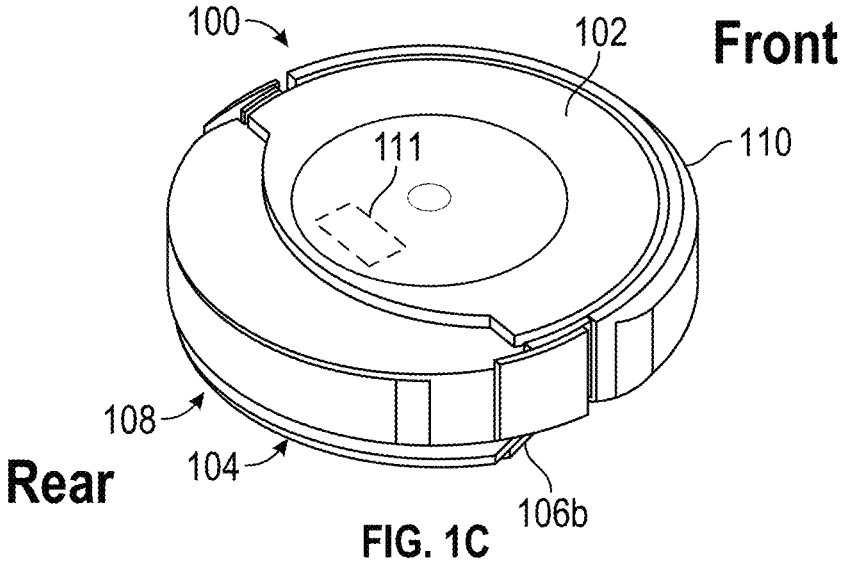
FIG. 1C illustrates an isometric view of a mobile cleaning robot in a third condition.

FIG. 1A illustrates an isometric view of a mobile cleaning robot 100 with a pad assembly in a stored position. FIG. 1B illustrates an isometric view of the mobile cleaning robot 100 with the pad assembly in an extended position. FIG. 1C illustrates an isometric view of the mobile cleaning robot 100 with the pad assembly in a mopping position. FIGS. 1A-1C also show orientation indicators Front and Rear. FIGS. 1A-1C are discussed together below.

The mobile cleaning robot 100 can include a body 102 and a mopping system 104. The mopping system 104 can include arms 106*a* and 106*b* (referred to together as arms 106) and a pad assembly 108. The robot 100 can also include a bumper 110 and other features such as an extractor (including rollers), one or more side brushes, a vacuum system, a controller, a drive system (e.g., motor, geartrain, and wheels), a caster, sensors, or the like, as shown in U.S. Patent Application Ser. No. 63/088,544, entitled "Two In One Mobile Cleaning Robot," filed on Oct. 7, 2020, to Michael G. Sack, which is incorporated by reference above. A proximal portion of the arms 106*a* and 106*b* can be connected to an internal drive system (such as shown and discussed in U.S. Patent Application Ser. No. 63/088,544). A distal portion of the arms 106 can be connected to the pad assembly 108.

The robot 100 can also include a controller 111 that can be located within the housing or body 102 and can be a programable controller, such as a single or multi-board computer, a direct digital controller (DDC), a programable logic controller (PLC), or the like. In other examples the controller 111 can be any computing device, such as a handheld computer, for example, a smart phone, a tablet, a laptop, a desktop computer, or any other computing device including a processor, memory, and communication capabilities. The memory can be one or more types of memory, such as volatile or non-volatile memory, read-only memory (ROM), random-access memory (RAM), magnetic disk storage media, optical storage media, flash-memory devices, and other storage devices and media. The memory can be located within the housing 102, connected to the controller 111 and accessible by the controller 111.

In operation of some examples, the controller 111 can operate the arms 106 to move the pad assembly 108 between a stored position (shown in FIG. 1A), an extended position (shown in FIG. 1B), and an operating or mopping position (shown in FIG. 1C). In the stored position or mobility position, the robot 100 can perform vacuuming operations only. In the mopping position, the robot can perform wet or dry mopping operations and vacuuming operations or can perform only mopping operations.

Figure 2A:
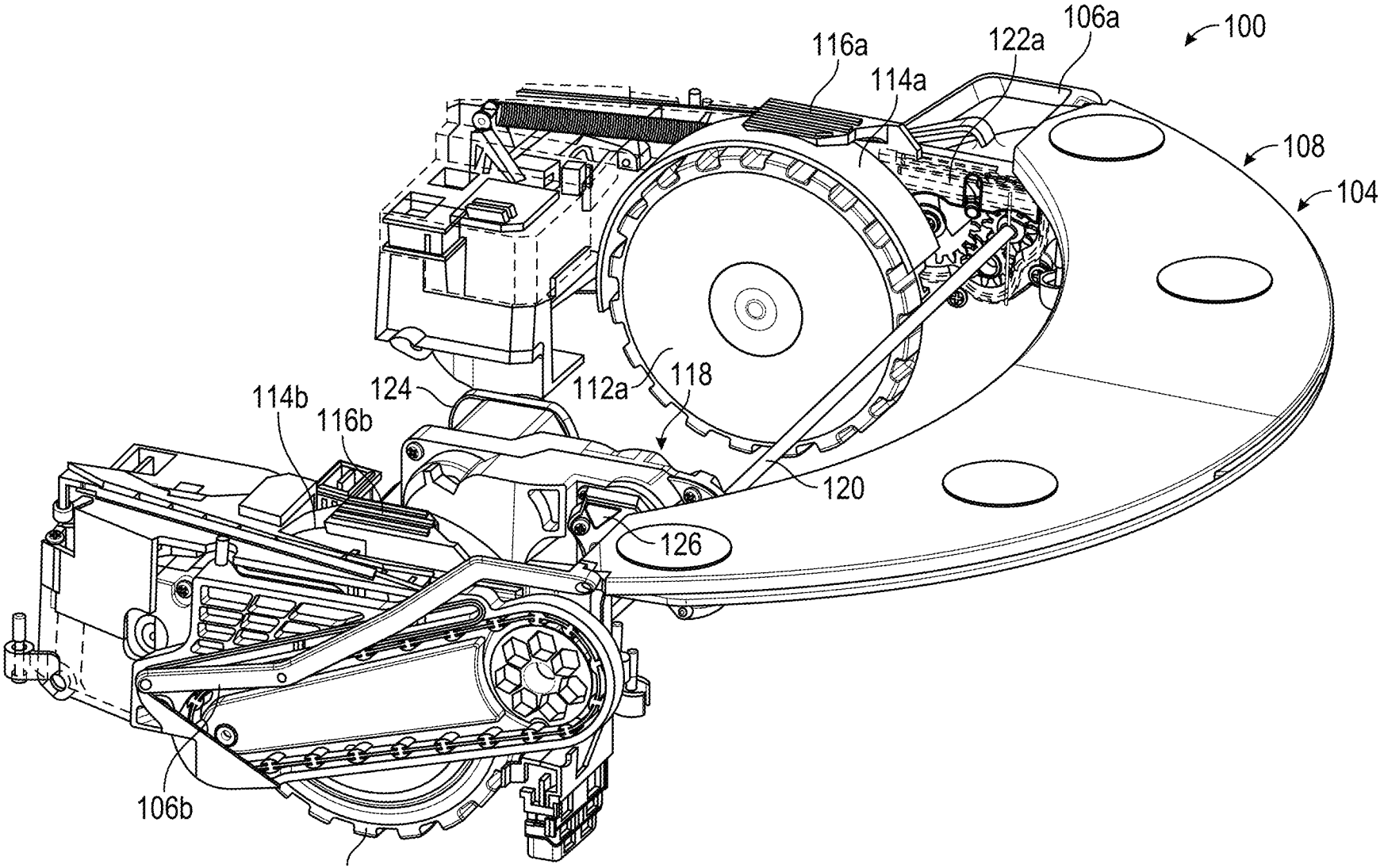
FIG. 2A illustrates an isometric view of a portion of a mobile cleaning robot.
Figure 2B:
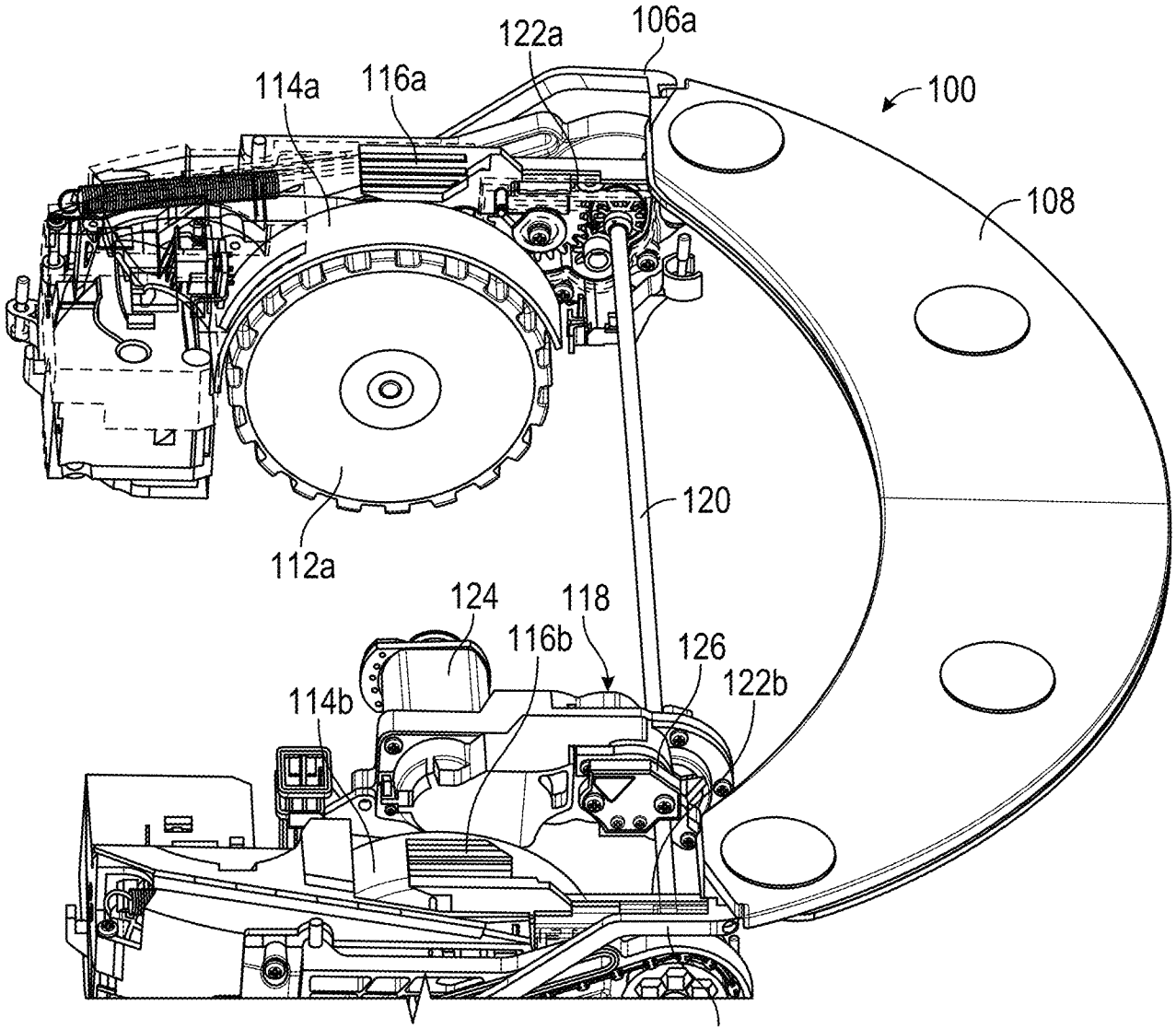
FIG. 2B illustrates an isometric view of a portion of a mobile cleaning robot.
Figure 2C:
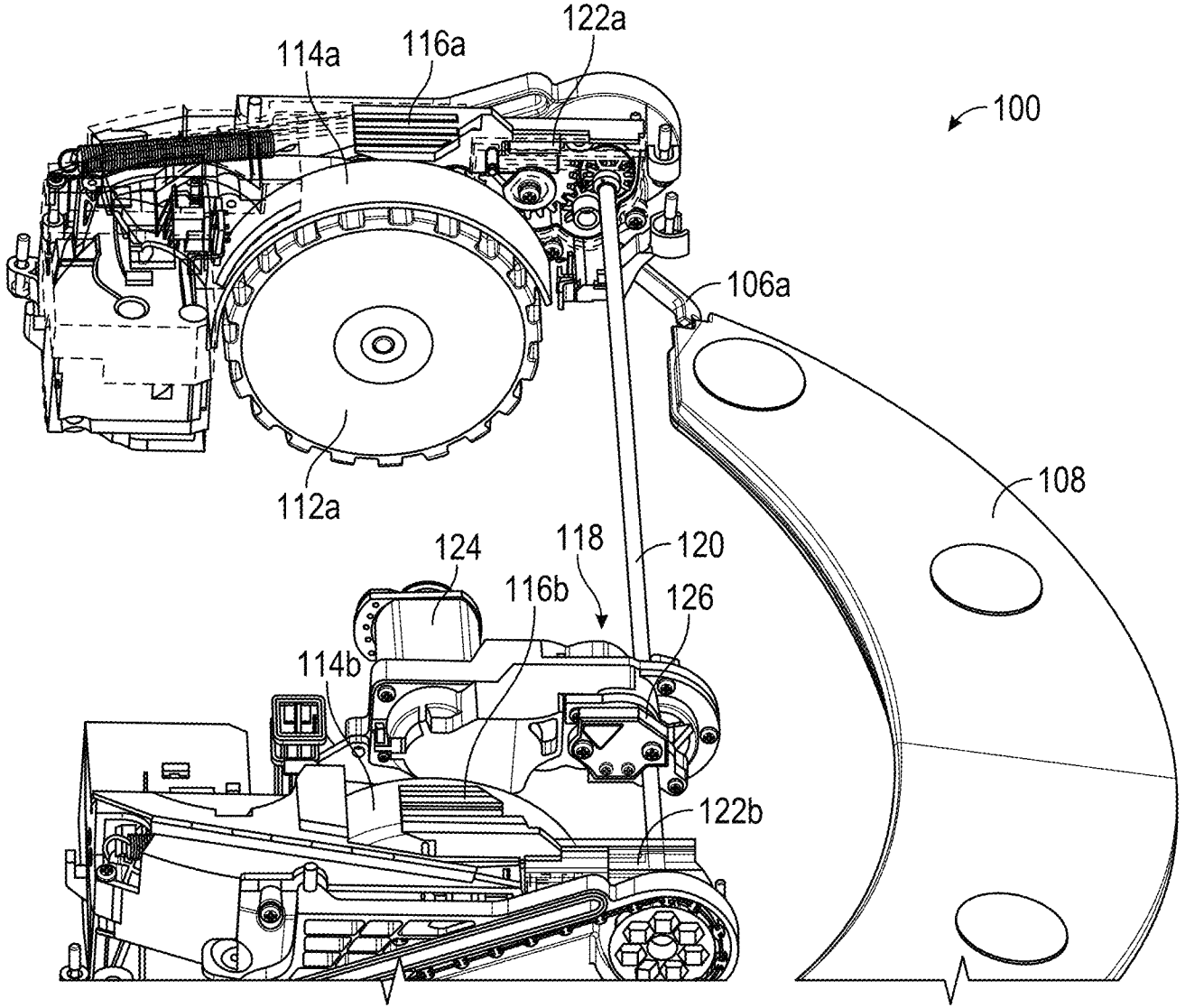
FIG. 2C illustrates an isometric view of a portion of a mobile cleaning robot.
Figure 2D:
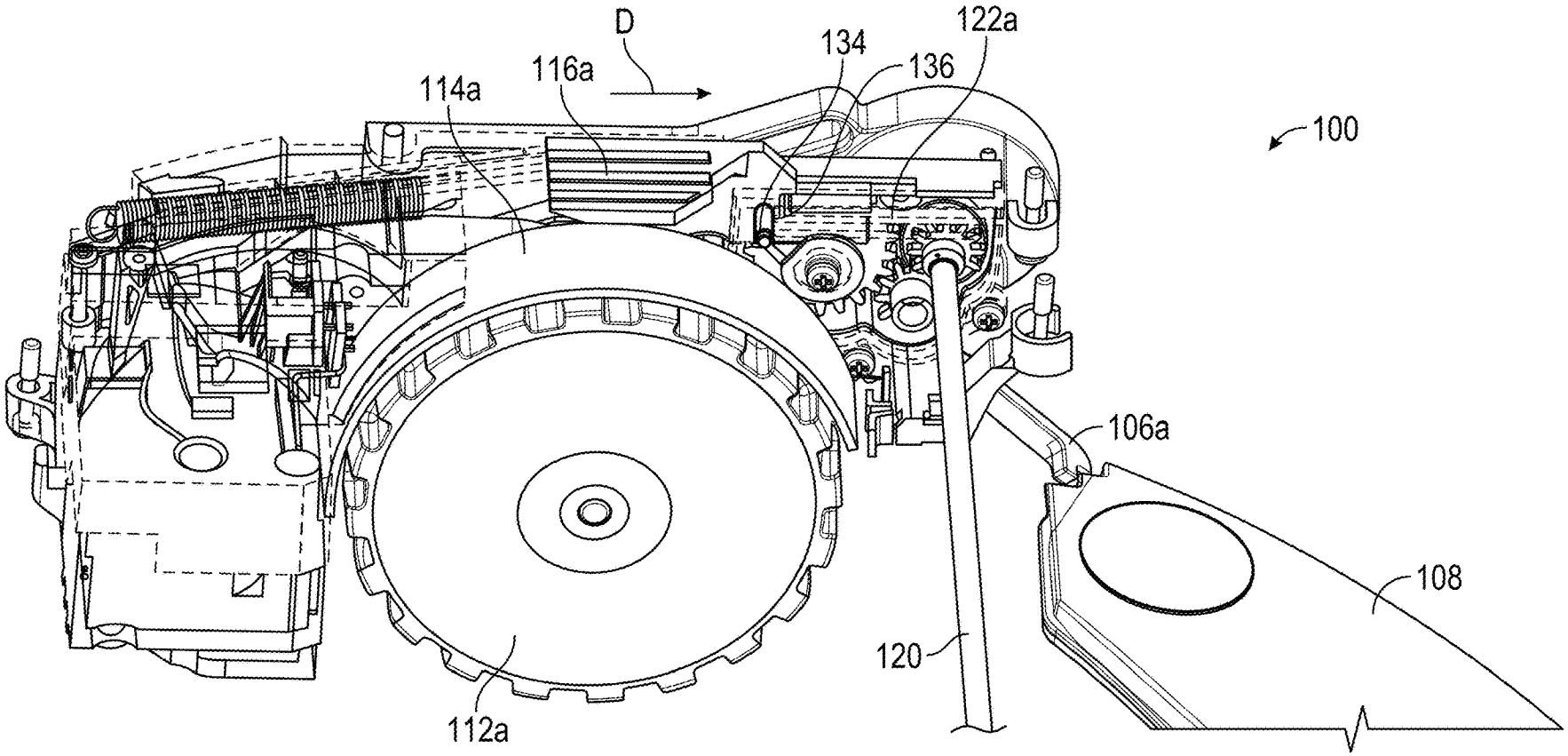
FIG. 2D illustrates an isometric view of a portion of a mobile cleaning robot.
Figure 2E:
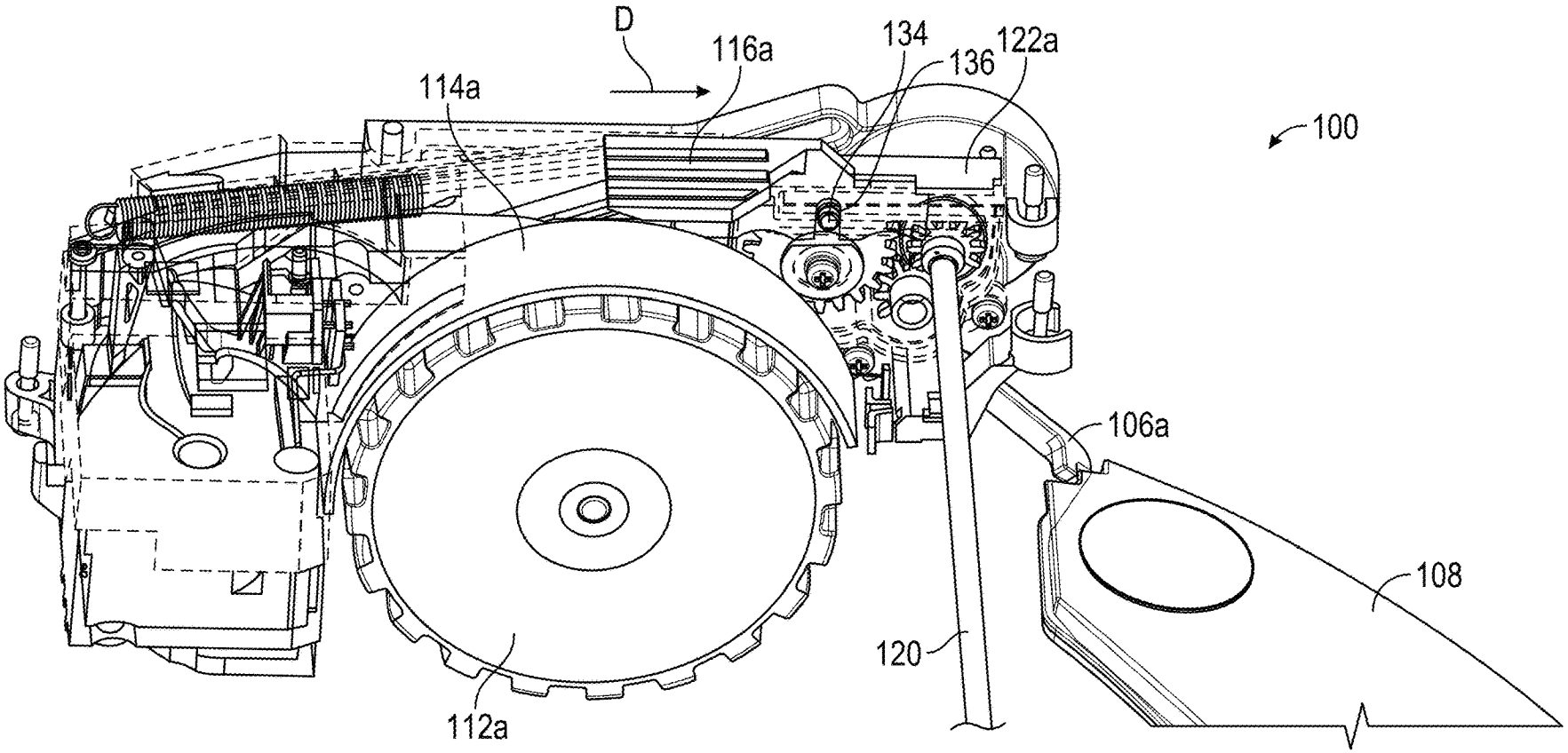
FIG. 2E illustrates an isometric view of a portion of a mobile cleaning robot.
Figure 2F:
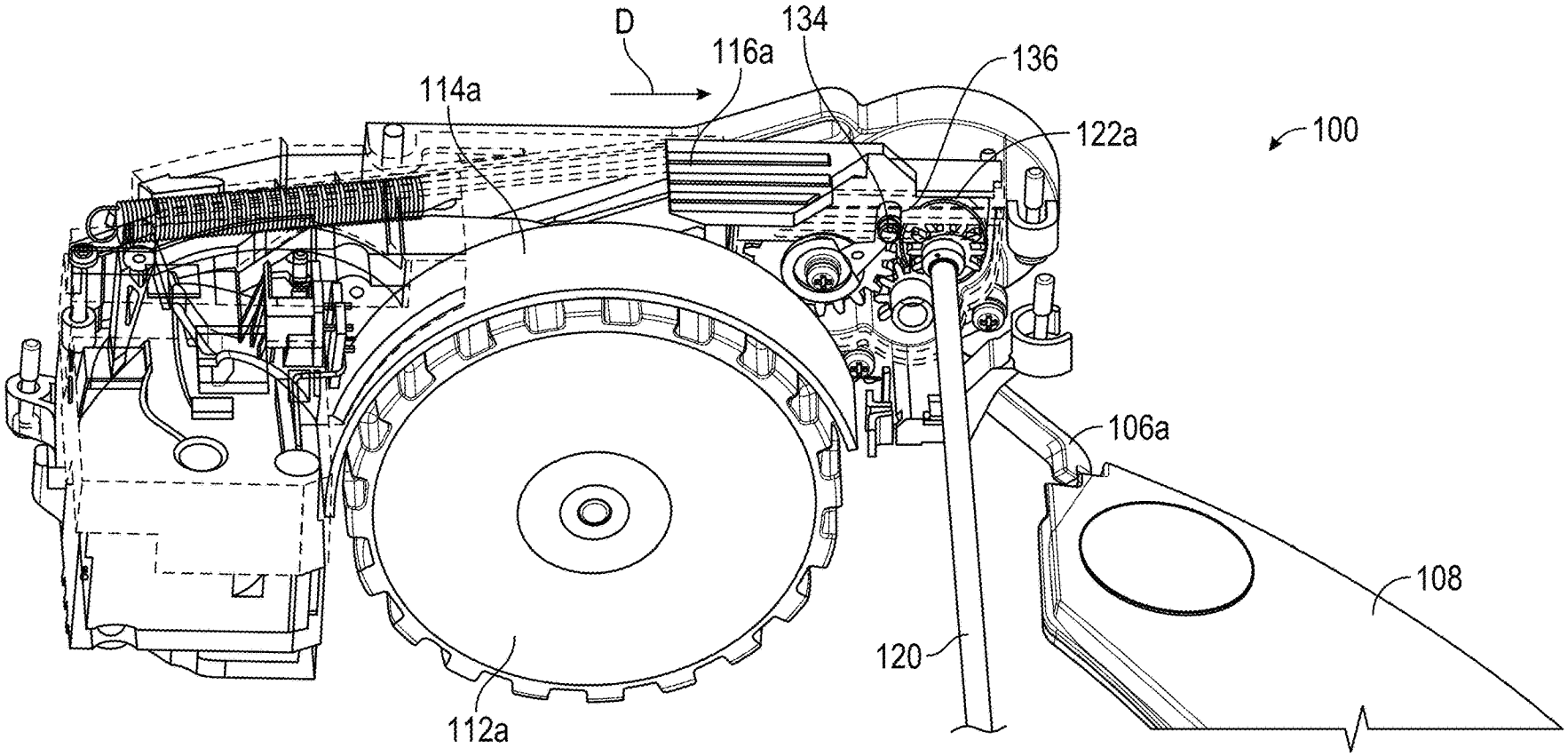
FIG. 2F illustrates an isometric view of a portion of a mobile cleaning robot.

FIG. 2A illustrates an isometric view of a portion of the mobile cleaning robot 100. FIG. 2B illustrates an isometric view of a portion of the mobile cleaning robot 100. FIG. 2C illustrates an isometric view of a portion of the mobile cleaning robot 100. FIG. 2D illustrates an isometric view of a portion of the mobile cleaning robot 100. FIG. 2E illustrates an isometric view of a portion of the mobile cleaning robot 100. FIG. 2F illustrates an isometric view of a portion of the mobile cleaning robot 100. FIGS. 2A-2F are discussed together below. The mobile cleaning robot 100 of FIGS. 2A-2F can be consistent with the mobile cleaning robot 100 of FIGS. 1A-1C; FIGS. 2A-2F show additional details of the mobile cleaning robot 100.

For example, FIG. 2A shows drive wheels 112*a* and 112*b* (collectively referred to as drive wheels 112), fenders 114*a* and 114*b* (collectively referred to as fenders 114), wheel stops 116*a* and 116*b* (collectively referred to as wheel stops 116), and a drive system 118. The drive system 118 can include a cross-shaft 120, gearboxes 122*a* and 122*b*, a motor 124, and an encoder 126.

The drive wheels 112 can be supported by the body 102 (shown in FIGS. 1A-1C) of the robot 100, can be located at least partially within the housing 102, and can extend through a bottom portion of the housing 102. The wheels 112 can also be connected to and rotatable with a shaft; the wheels 112 can be configured to be driven by motors to propel the robot 100 along a surface of the environment, where the motors can be in communication with a controller 111 to control such movement of the robot 100 in the environment.

The fenders 114*a* and 114*b* can be rigid or semi-rigid fenders or guards surrounding at least a portion of the wheels 112*a* and 112*b*, respectively. The fenders 114*a* and 114*b* can be associated with or part of an assembly including the drive wheels 112*a* and 112*b*, respectively. The fenders 114*a* and 114*b*, can be spaced from the wheels 112*a* and 112*b*, respectively, and can move therewith to maintain a fixed (or substantially fixed) distance between respective drive wheels 112 and fenders 114. As discussed in further detail below, the fenders 114*a* and 114*b* can be engageable with the wheel stops 116*a* and 116*b*, respectively, or the body 102 to set a wheel travel of the robot 100. Optionally, the wheel stops 116*a* and 116*b* can engage another component of the wheel assembly to set the wheel travel and force distribution.

The wheel stops 116*a* and 116*b* can be rigid or semi-rigid suspension components (travel stops) located near the fenders 114*a* and 114*b*, respectively. The wheel stops 116*a* and 116*b* can be connected to the gearboxes 122*a* and 122*b*, respectively, such that movement of the gearboxes 122 can cause movement (e.g., translation) of the wheels stops 116 with respect to the body 102 and with respect to the wheels 112 and fenders 114 between a stop position and a release position. The wheel stops 116 can be engageable with the fenders 114 (or wheels 112 or wheel assemblies) in the stop position to limit vertical travel of the drive wheels 112 with respect to the body 102 and to transfer additional weight of the robot 100 to the drive wheels 112. The wheel stops 116 can also be positioned to avoid contact with the fenders 114 or drive wheels 112 in the release position, such as to allow different wheel travel (e.g., greater wheel travel) than when the stops 116 are in the stop position, which can transfer additional weight or load of the robot 100 to a rear portion to increase load or weight of the robot applied through the pad assembly 108.

The motor 124 of the drive system can be connected to an encoder 126 (and optionally to a gear train or gearbox). The motor 124 can be connected to the cross-shaft 120, which can extend between the gearboxes 122*a* and 122*b* such as to deliver rotation from the motor 124 to the gearboxes (or gear assemblies) 122*a* and 122*b* (to move the wheel stops 116) to change the mode of the mobile cleaning robot 100 between a vacuuming mode and a mopping mode. The vacuuming mode can be a mode of operation of the robot 100 where the pad assembly 108 is in the stored position or is not in the deployed position, where the robot 100 can optionally performing cleaning operations such as vacuuming, and can perform navigation operations. The mopping mode can be a mode of operation of the robot 100 where the pad assembly 108 is in a deployed (or at least partially-deployed) condition or state such that the pad assembly 108 can perform mopping (e.g., dry mopping or wet mopping) operations and can optionally perform vacuuming operations and navigation operations.

The cross-shaft 120 can be a single piece shaft or a multiple piece shaft. The cross-shaft 120 can be aligned (co-axial) with the driven gear of the gearboxes 122*a* and 122*b*, but can optionally be offset from the gearboxes 122, such as to save space within the body 102 of the robot 100. The pad assembly 108 can be connected to the drive system 118 via the arms 106*a* and 106*b* connecting to the gearboxes 122*a* and 122*b*, respectively (such as indirectly).

In operation of some examples, the pad assembly can be in a stored position (as shown in FIGS. 1A and 2B) where a large percentage of the weight of the robot 100 can be transferred through the drive wheels 112, which can improve navigation of the robot 100 through carpeting and over thresholds and can help to ensure a proper force is distributed through a cleaning head of the robot 100. In such a position, the vertical wheel travel can be smaller (relative to wheel travel in the vacuuming mode) and can be dictated, at least in part, by contact between a top surface of the fenders 114*a* and 114*b* and a bottom surface of the wheel stops 116*a* and 116*b*, respectively.

When it is desired to operate the robot 100 in a mopping mode, the drive system 118 can be operated (such as by the controller 111) to move the pad assembly 108 from the stored position in the vacuuming mode and the mopping position (as shown in FIGS. 1C and 2C) in the mopping mode. Once the pad assembly 108 reaches a floor surface (as shown in FIGS. 2C and 2D), the drive system 118 can operate the gearboxes 122*a* and 122*b* to translate the wheel stops 116*a* and 116*b* in the direction D (rearward) away from the wheels 112*a* and 112*b* and fenders 114*a* and 114*b*, respectively. Optionally, the wheel stops can be configured to translate in the opposite direction to direction D (forward). The translation can continue until the fenders 114*a* and 114*b* are relatively unimpeded by the wheel stops, as shown in FIG. 2F. With the wheel stops 116*a* and 116*b* clear of the fenders 114*a* and 114*b*, respectively, the wheel travel can be increased, as discussed below, and a force applied by the pad assembly 108 can be increased.

Figure 3A:
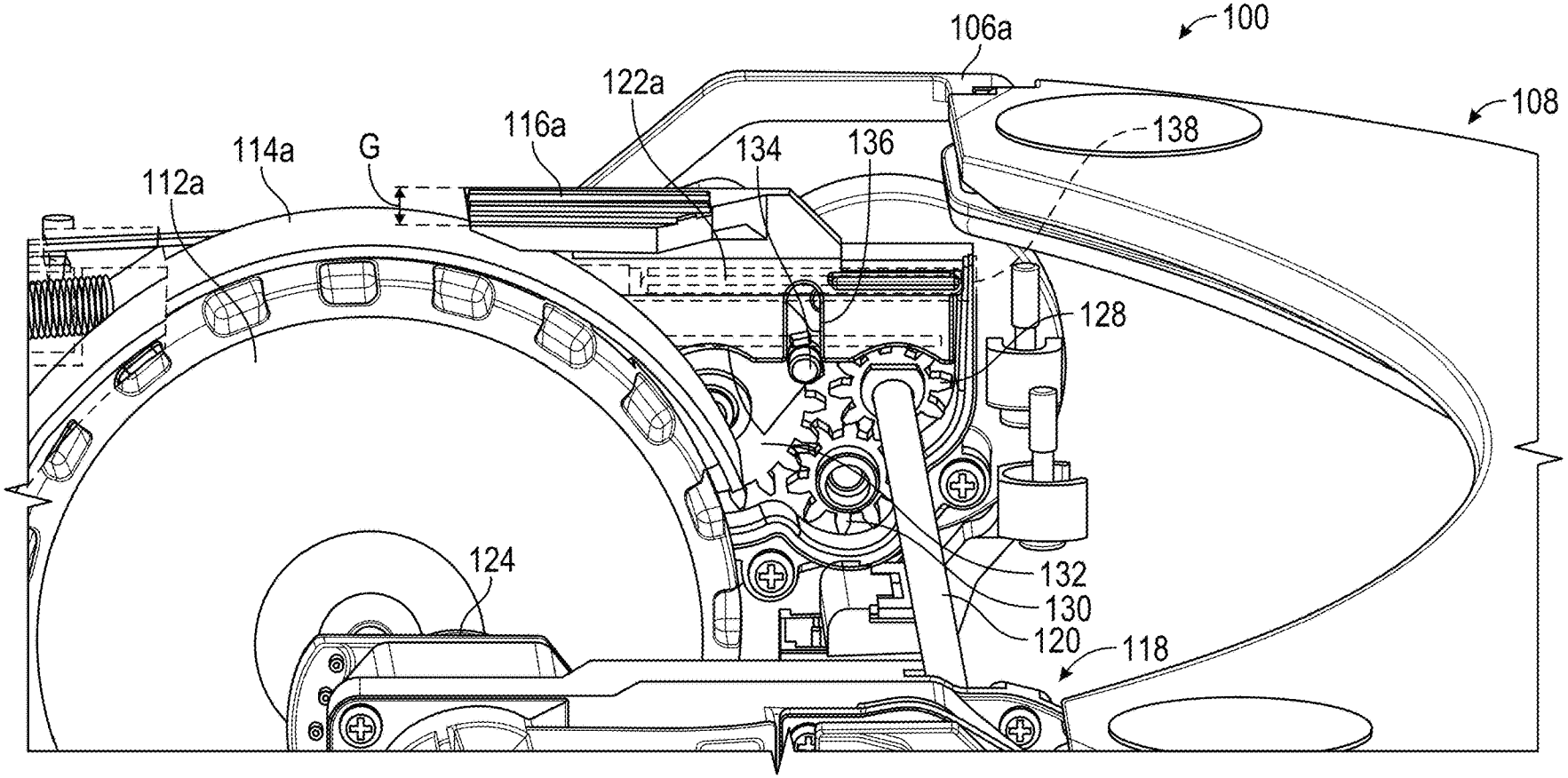
FIG. 3A illustrates an isometric view of a portion of a mobile cleaning robot.
Figure 3B:
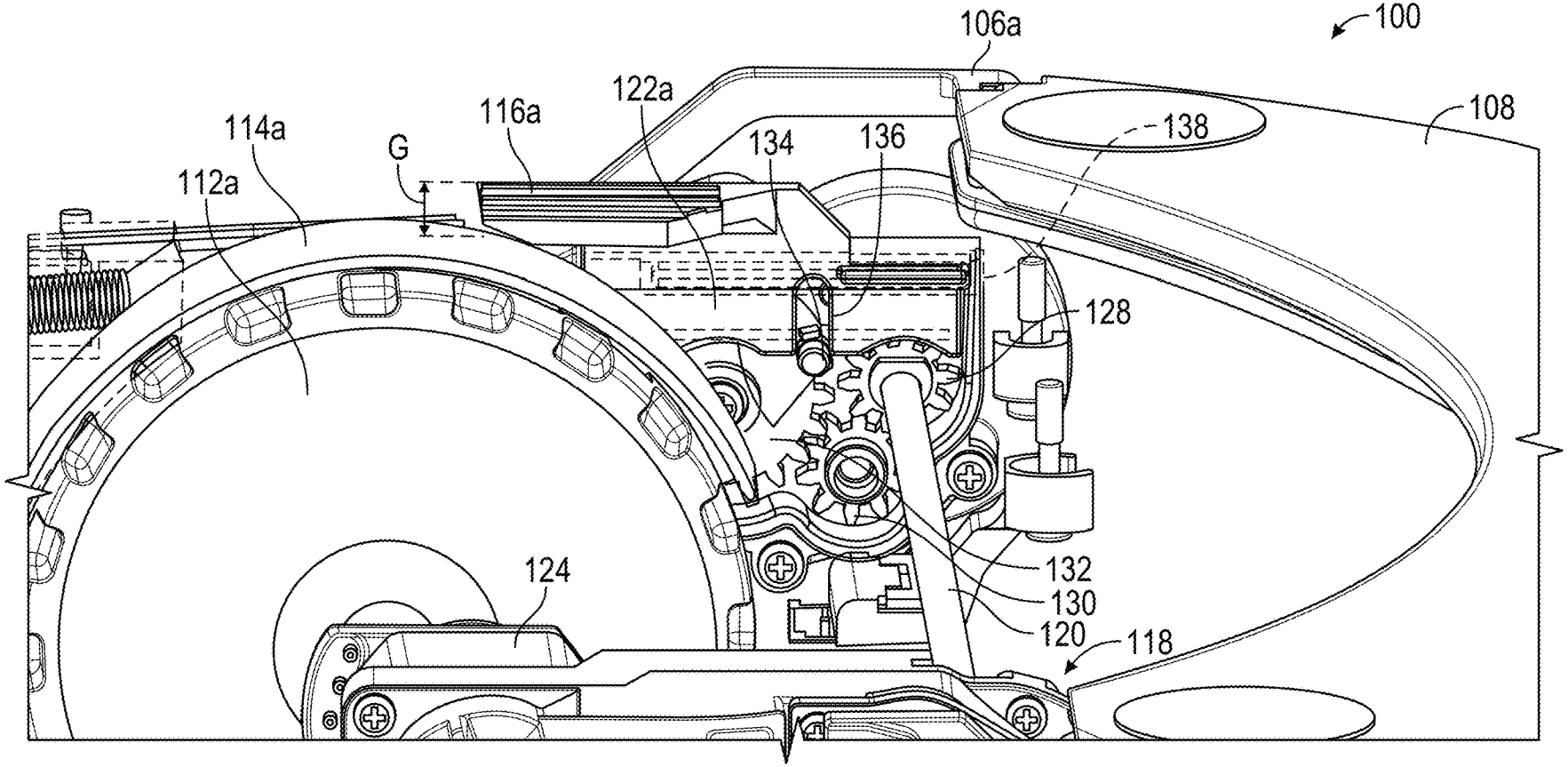
FIG. 3B illustrates an isometric view of a portion of a mobile cleaning robot.

FIG. 3A illustrates an isometric view of a portion of the mobile cleaning robot 100. FIG. 3B illustrates an isometric view of a portion of the mobile cleaning robot 100. FIGS. 3A and 3B are discussed together below. The mobile cleaning robot 100 of FIGS. 3A-3B can be consistent with the mobile cleaning robot 100 of FIGS. 1A-2F.

As discussed above, when the wheel stops 116*a* and 116*b* are moved clear of the fenders 114*a* and 114*b*, respectively, the wheel travel of the drive wheels 112 can be dictated by engagement between the fenders 114 and a bottom portion of the chassis or housing 102, such that the wheel travel of the drive wheels 112 can be increased as indicated by a gap G between the fender 114*a* and a bottom of the chassis or body 102, shown in FIGS. 3A and 3B (where the gap G of FIG. 3B is larger).

FIGS. 3A and 3B also show that the gearbox 122*a* (and 122*b*) can include a drive gear 128, a reversing gear 130, and a Geneva gear 132 (or timing gear or timing mechanism). The Geneva gear 132 can include a boss 134 and the wheel stop 116*a* can include a slot 136. Together, the gears can work to transform rotation of the drive shaft 120 into translation of the wheel stop 116*a*. The gearbox 122*b* and the wheel stop 116*b* can operate similarly.

More specifically, the drive gear 128, the reversing gear 130, and the Geneva gear 132 can be located at least partially within a housing 138 of the gearbox 122*a*. The housing 138 can include or can receive bearings (such as pins, bosses, or ball bearings) configured to support each of the gears (128, 130, 132). The driven or driving gear 128 can be connected to the cross-shaft 120 and can be engaged with the reversing gear 130 to reverse a direction of rotation of the cross-shaft 120. The Geneva gear 132 can be relatively larger than the driving gear 128, such that the driving gear 128 can rotate faster than the Geneva gear 132, such as to have a gear ratio of between 1.5:1 and 2.5:1. In some examples, the driving gear 128 and the Geneva gear 132 can have a ratio of about 2.2:1.

The boss 134 of the Geneva gear 132 can be engaged with the slot 136 of the wheel stop 116*a* to form a timing mechanism for movement of the wheel stop 116*a*. That is, the boss 134 of the Geneva gear 132 can engage the slot 136 to cause translation of the wheel stop 116*a* in response to rotation of the Geneva gear 132, but only during a portion of the travel (rotation) of the Geneva gear 132 about its axis. The boss 134 can be positioned on the Geneva gear 132 such that it does not engage the slot 136 until the pad assembly 108 engages the floor surface. Once the boss 134 engages the slot 136, the wheel stop 116 can be translated away from the fender 114 by the Geneva gear 132.

In this way, the gearbox 122*a* can be timed with respect to the drive system 118 to ensure that there is sufficient clearance between the body 102 and the floor surface 50 for the pad assembly 108 to fit under the body 102. This helps ensure that the drive system 118 does not have to apply force to lift the robot 100 off the floor surface to move the pad assembly 108 to a position (at least partially) underneath the body 102. Instead, the wheel stops 116 remain in position (to limit the wheel travel) until after the pad assembly 108 is engaged with the floor surface and is therefore distributing load or weight of the robot 100 to the floor surface through the pad assembly 108 before the Geneva gear 132 moves the wheel stop 116*a*, releasing more weight or load onto the pad assembly 108.

Referring back to FIGS. 2D-2F, it can be seen that once the pad assembly 108 engages the floor, the boss 134 can engage the slot. As the boss 134 continues to rotate (clockwise from the perspective of FIGS. 2D-3B), the slot 136 is engaged and the wheel stop 116*a* is translated in the direction D, as shown in FIG. 2E. The boss 134 can continue to drive translation of the wheel stop 116*a* until the wheel stop engages the housing 138, as shown in FIG. 2F, or until the controller 111 stops rotation of the motor 124, such as based on a signal from the encoder 126.

To translate the wheel stop 116*a* back to the mobility position (over the fender 114*a*), the motor 124 can be operated to rotate the shaft 120 in the opposite direction to ultimately drive the Geneva gear 132 and the boss 134 to rotate in the opposite direction (counter-clockwise from the perspective of FIGS. 2D-3B) to cause the boss 134 to engage the slot 136 and cause translation of the wheel stop 116*a* to a position above the fender 114*a*. Such a process can be used as necessary each time a mode (e.g., vacuuming mode or mopping mode) is changed.

Figure 4:
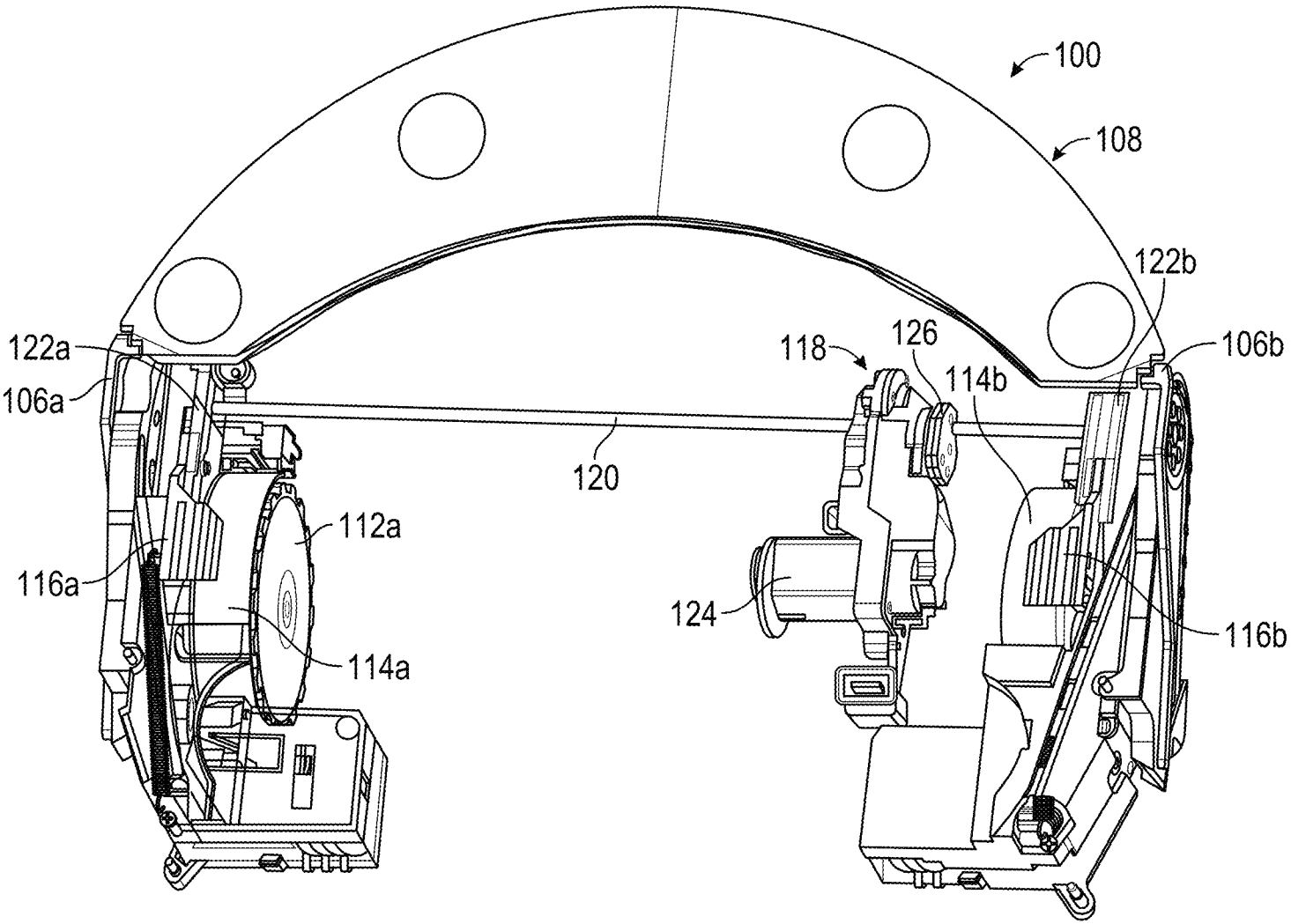
FIG. 4 illustrates an isometric view of a portion of a mobile cleaning robot.

FIG. 4 illustrates an isometric view of a portion of the mobile cleaning robot 100. The mobile cleaning robot 100 of FIG. 4 can be consistent with the mobile cleaning robot 100 of FIGS. 1A-3B. FIG. 4 shows, more clearly, that the encoder 126 can be connected to the drive system 118 and the cross shaft 120. As such, the encoder 126 can monitor a position of the cross-shaft 120 (or a shaft driving the cross-shaft 120) that can be transmitted through a position signal (or encoder signal) to the controller 111. The controller 111 can thereby determine a position of the pad assembly 108 with respect to the robot and can determine a position of the wheel stops 116 with respect to the wheels 112 (and fenders 114). The controller 111 can use these positions to guide movement and actions of the robot 100.

Figure 5A:
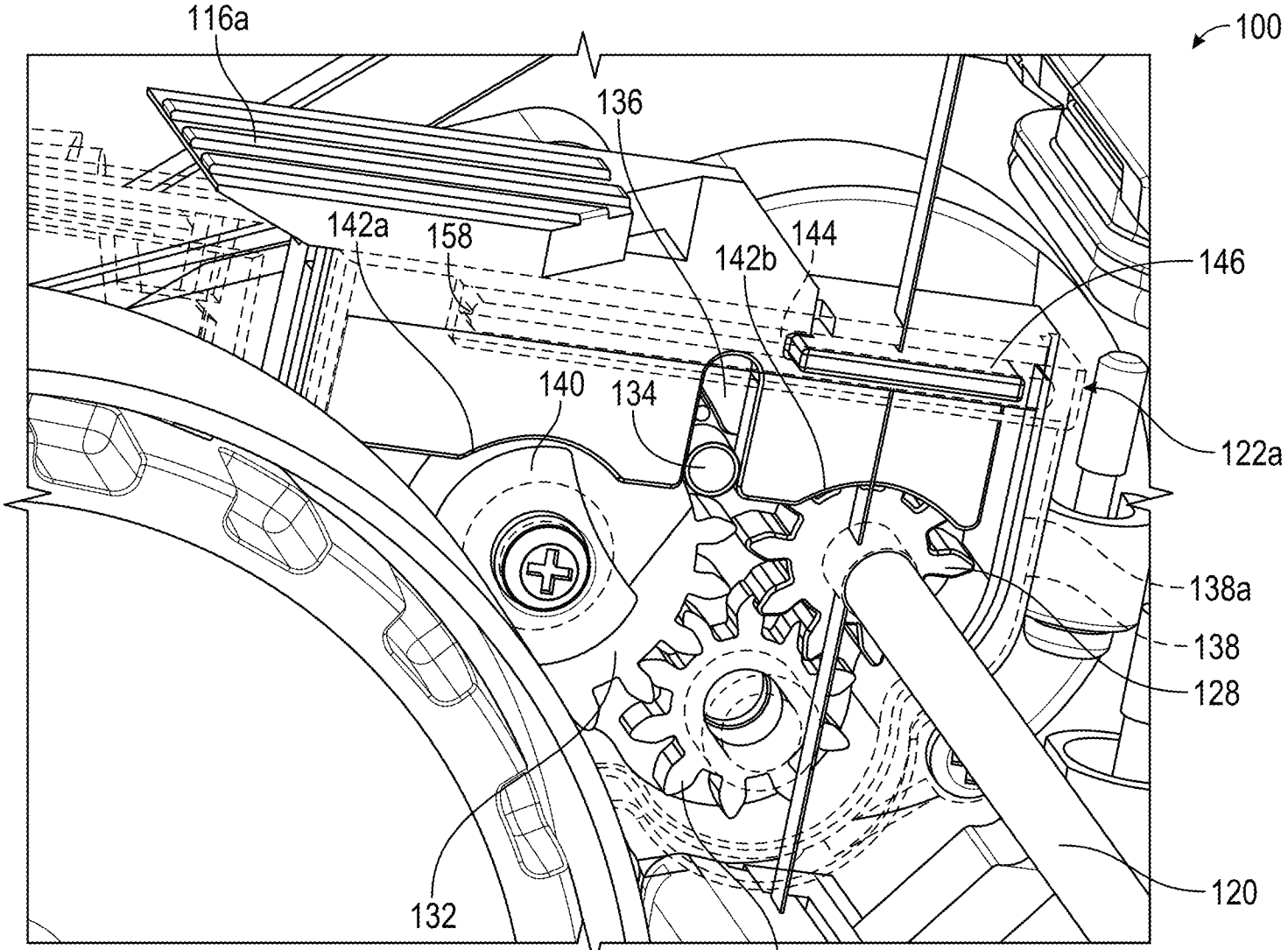
FIG. 5A illustrates an isometric view of a portion of a mobile cleaning robot.
Figure 5B:
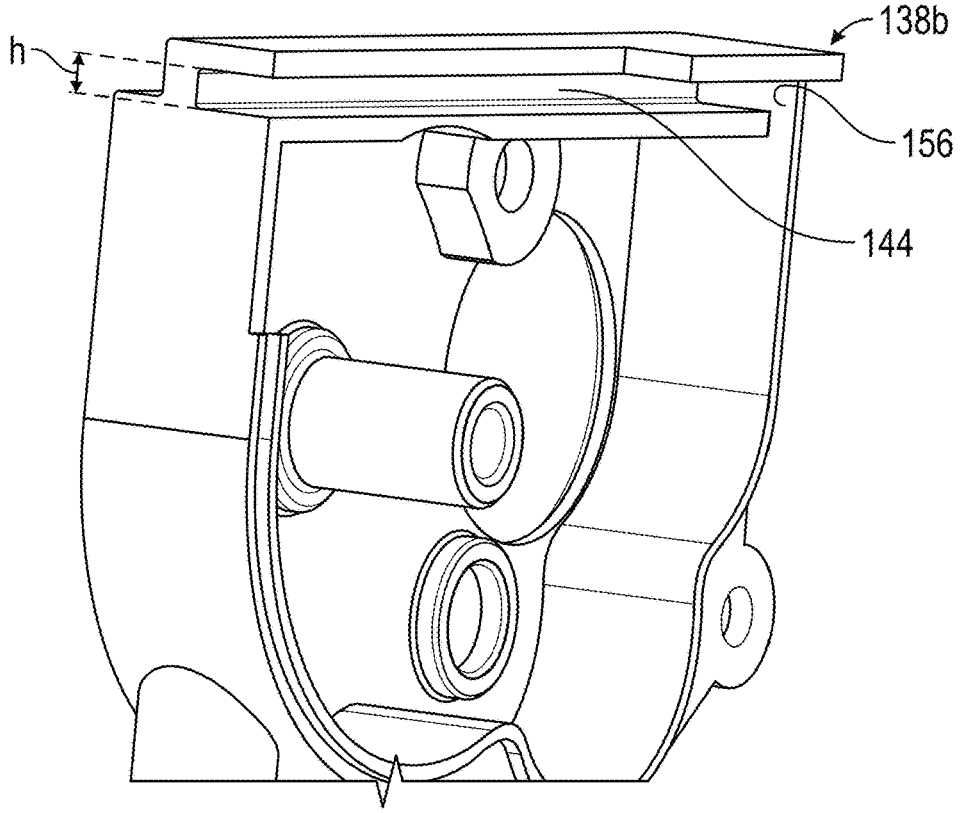
FIG. 5B illustrates an isometric view of a portion of a mobile cleaning robot.
Figure 5C:
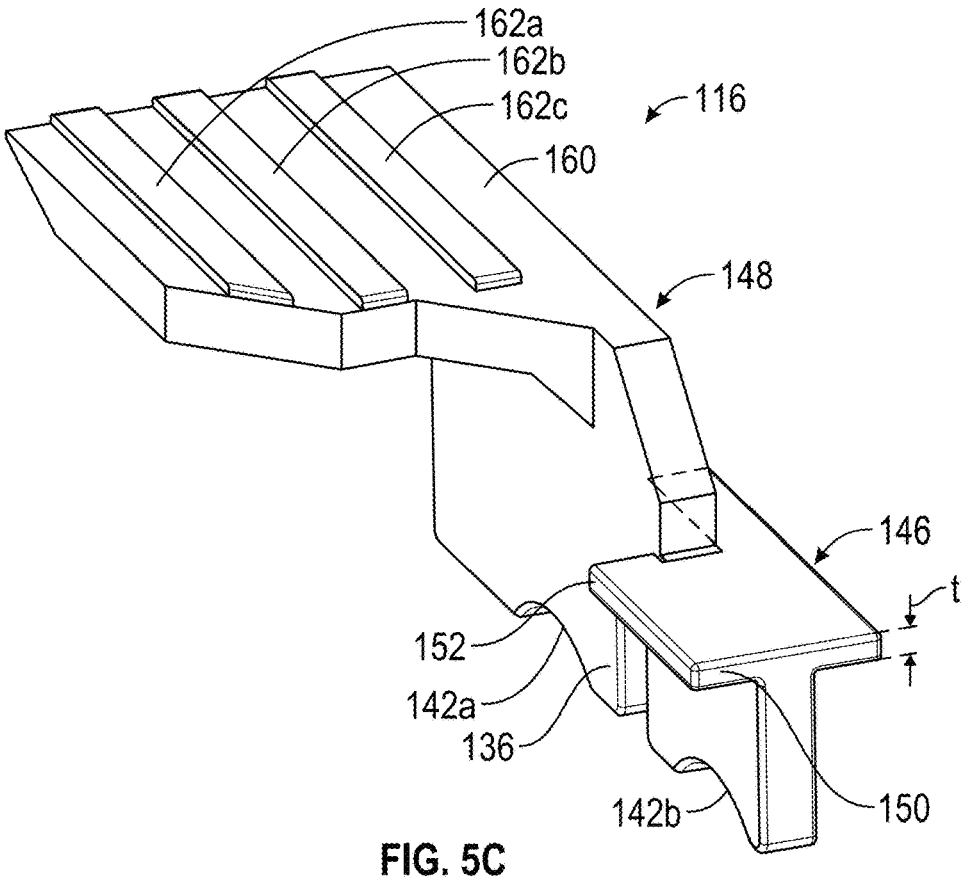
FIG. 5C illustrates an isometric view of a portion of a mobile cleaning robot.

FIG. 5A illustrates an isometric view of a portion of the mobile cleaning robot 100. FIG. 5B illustrates an isometric view of a portion of the mobile cleaning robot 100. FIG. 5C illustrates an isometric view of a portion of the mobile cleaning robot 100. FIGS. 5A-5C are discussed together below. The mobile cleaning robot 100 of FIGS. 5A-5C can be consistent with the mobile cleaning robot 100 of FIGS. 1A-4; FIGS. 5A-5C show additional details of the robot 100. For example, FIG. 5A shows that the Geneva gear 132 can include a collar 140 and the wheel stop 116*a* can include supports 142*a* and 142*b* (also shown in FIG. 5C).

The collar 140 can be a portion of the Geneva gear 132 extending around a portion of a circumference of the axis of the gear 132 and can form a ledge to engage either of the supports 142*a* or 142*b* to help transmit forces between the wheel stop 116 and the body 102. When the wheel stop 116 is in the vacuuming mode, the support 142*b* can engage the collar 140 and when the wheel stop 116 is in the mopping mode, the support 142*a* can engage the collar 140. The collar 140 can be incomplete around a circumference of the axis of the gear 132 to allow the wheel stop 116 to translate with respect to the Geneva gear 132. The incomplete portion can be timed with the boss 134 to allow such movement. Optionally, the drive gear 128 can include a collar similar to that of the Geneva gear.

FIG. 5A also shows that the housing 138 can include or can define a track 144 to receive a guide 146 of the stop 116 to guide movement of the wheel stop 116 with respect to the housing 138 and the drive wheel 112. FIG. 5B shows a half 138*b* of the housing 138 that can define at least a portion of the track 144 and a half 138*a* (of FIG. 5A) can define another portion of the track 144.

FIG. 5C more clearly shows the guide 146 of a body 148 of the wheel stop 116. The guide 146 can be a relatively flat projection extending from both sides of the body 148. The guide 146 can define a first end 150 and a second end 152. The first end 150 can be engageable with an end 156 (shown in FIG. 5B) of the track 144 (i.e., the housing 138) to limit translation of the wheel stop 116 with respect to the housing 138, the body 102, and the wheel 112 in a first direction (e.g., away from the wheel—moving to the mopping mode). The second end 152 can be engageable with an end 158 (shown in FIG. 5A) of the track 144 (i.e., the housing 138) to limit translation of the wheel stop 116 with respect to the housing 138, the body 102, and the wheel 112 in a second direction (e.g., toward the wheel-moving to the vacuuming mode). The lateral stops 156 and 158 of the track 144 can, together with the guide 146, help to define or limit translation of the wheel stop 116.

The track 144 can also define a height h (shown in FIG. 5B) and the guide 146 can define a thickness t. The difference between the thickness t and the height h can define a limit to relative vertical movement of the wheel stop 116 with respect to the housing 138 and therefore the body 102 to control a trajectory of the wheel stop 116 while still ensuring alignment between the wheel stop 116 and the Geneva gear 132. In some examples, the difference can be between 0.05 millimeters (mm) and 1 mm. The difference can also be between 0.1 and 0.5 millimeters. The difference can also be about 0.3 millimeters.

FIG. 5C also shows that the wheel stop 116 can include ribs 162*a*-162*c* (collectively referred to as ribs 162) extending from a top portion or surface 160 of the wheel stop 116. The ribs 162*a*-162*c* can be engageable with the body 102 of the robot 100 when the wheel stop 116 is in the stop position (when the robot is in the vacuuming mode). The ribs 162 can thereby help to define a wheel travel of the drive wheels 112 of the robot 100 in the vacuuming mode and can transfer forces between the wheels 112 (and the fenders 114) to the body 102. Also, by being raised off the top portion 160 of the body 148 to define a relatively smaller contact area with the body 102, the ribs 162 can help to reduce friction between the wheel stop 116 and the body 102 and can help allow for debris to escape from the top surface 160 to help limit impact of wheel travel caused by debris.

Figure 6:
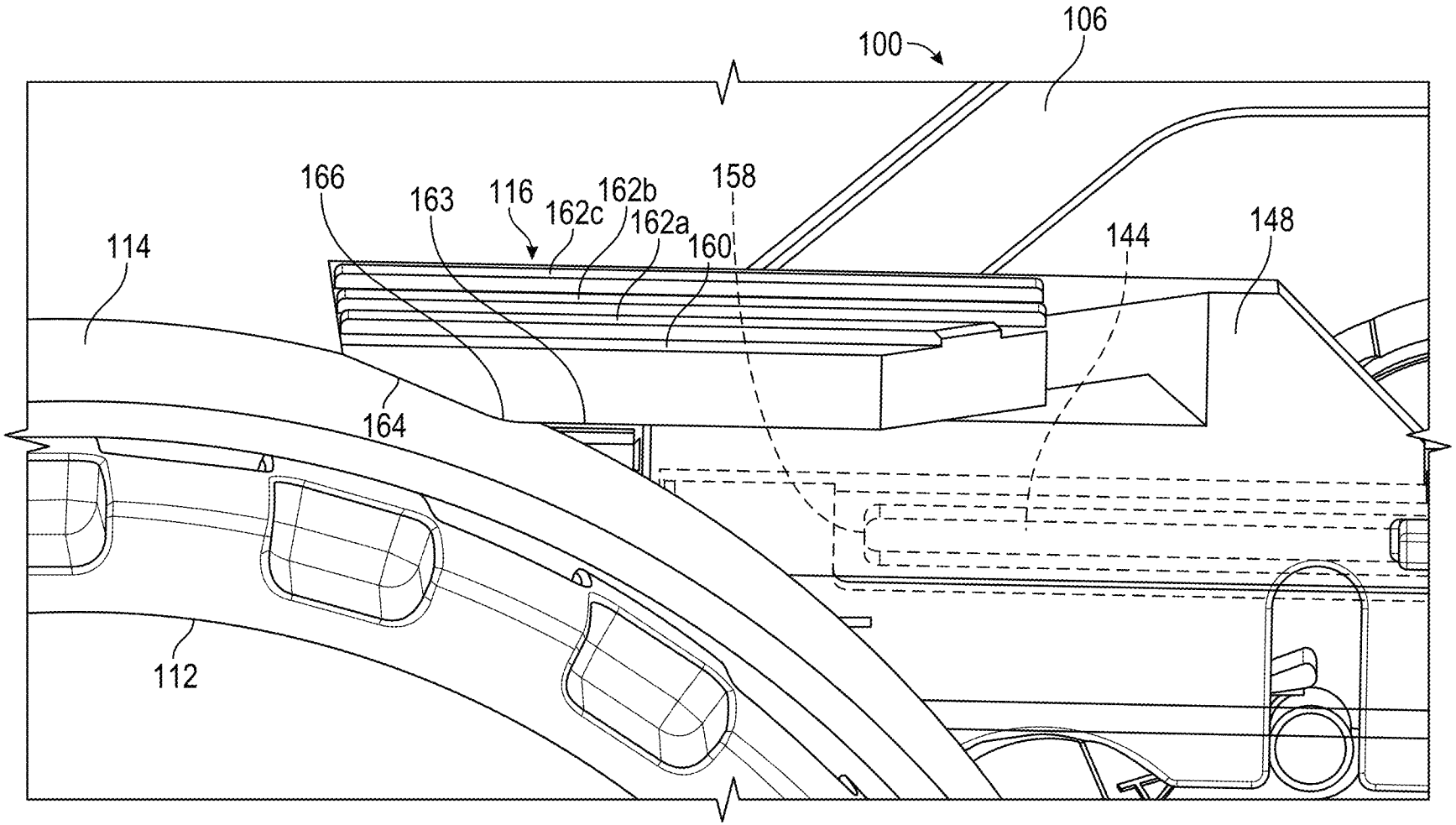
FIG. 6 illustrates an isometric view of a portion of a mobile cleaning robot.

FIG. 6 illustrates an isometric view of a portion of the mobile cleaning robot 100. The mobile cleaning robot 100 of FIG. 6 can be consistent with the mobile cleaning robot 100 of FIGS. 1A-5C; FIG. 6 shows additional details of the robot 100. For example, FIG. 6 shows that the wheel stop 116 can include a chamfer 164 on a bottom surface 163 of the top portion 160.

The chamfer 164 can include a rounded surface 166 and the fender 114 can also be rounded. The chamfer 164 and rounded surface or portion 166 can be configured to engage the fender 114 when the wheel stop 116 is moved from the release position (in mopping mode) to the stop position (in vacuuming mode). Engagement between the rounded surface or portion 166 and the fender 114 when the wheel stop moves to the stop position can cause the wheel stop 116 and the body 102 to move upward. Because the top portion 160 is chamfered and rounded, friction can be reduced between the fender 114 and the wheel stop 116 during such engagement when moving the wheel stop 116 to a position between the fender 114 and the body 102.

Figure 7:
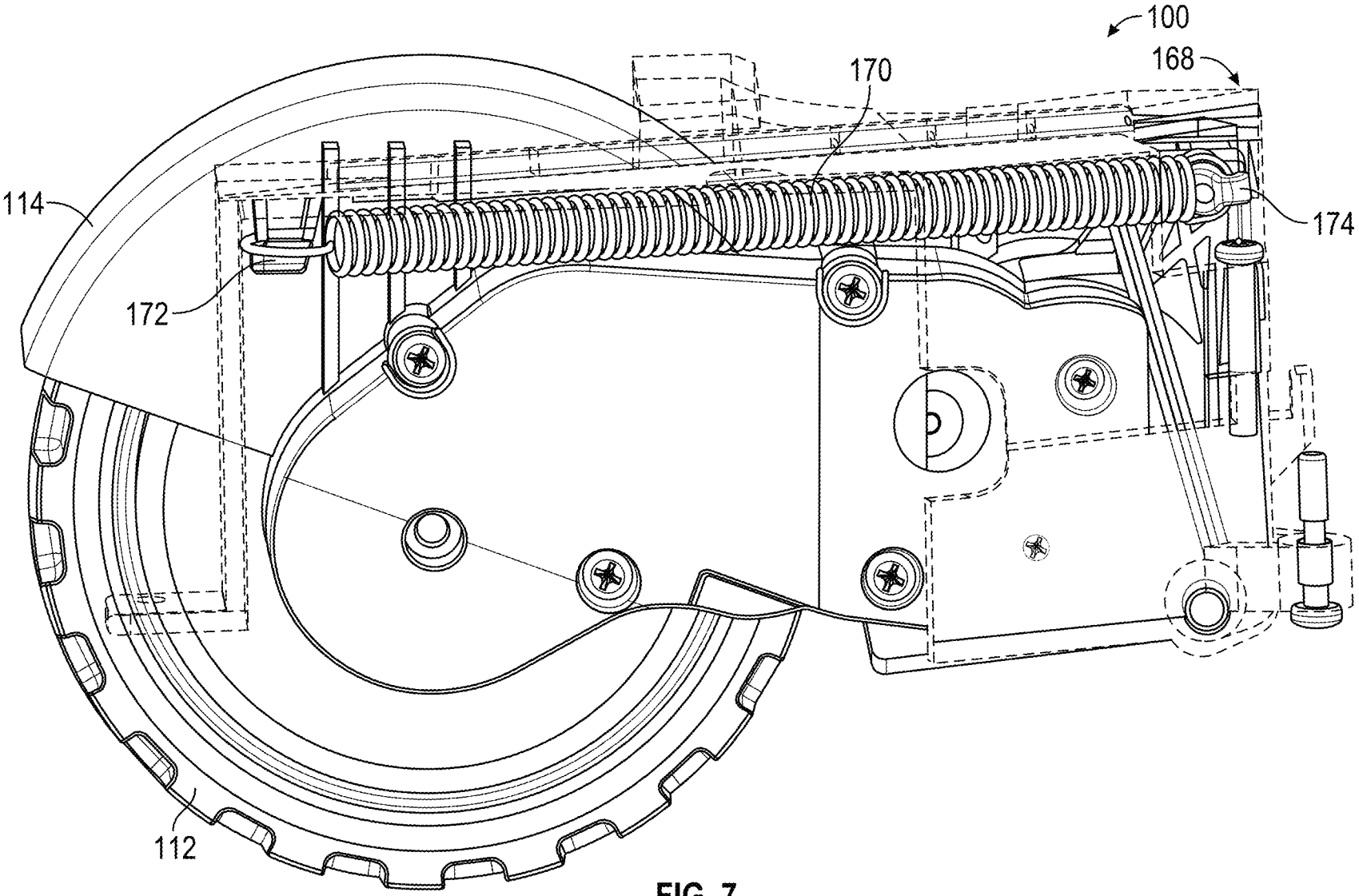
FIG. 7 illustrates an isometric view of a portion of a mobile cleaning robot.

FIG. 7 illustrates an isometric view of a portion of the mobile cleaning robot. The mobile cleaning robot 100 of FIG. 7 can be consistent with the mobile cleaning robot 100 of FIGS. 1A-6; FIG. 7 shows additional details of the robot 100. For example, FIG. 7 shows a spring module 168 for the drive wheel 112. The spring module 168 can include a biasing element 170 (e.g., an extension coil spring) and a hook 172 configured to secure a first end of the biasing element 170. The wheel 112 (including the motor and gearbox assembly) can include a hook 174 configured to secure a second end of the biasing element 170. The biasing element 170 of the spring module 168 can thereby bias the wheel downward toward the ground (vertical).

Figure 8:
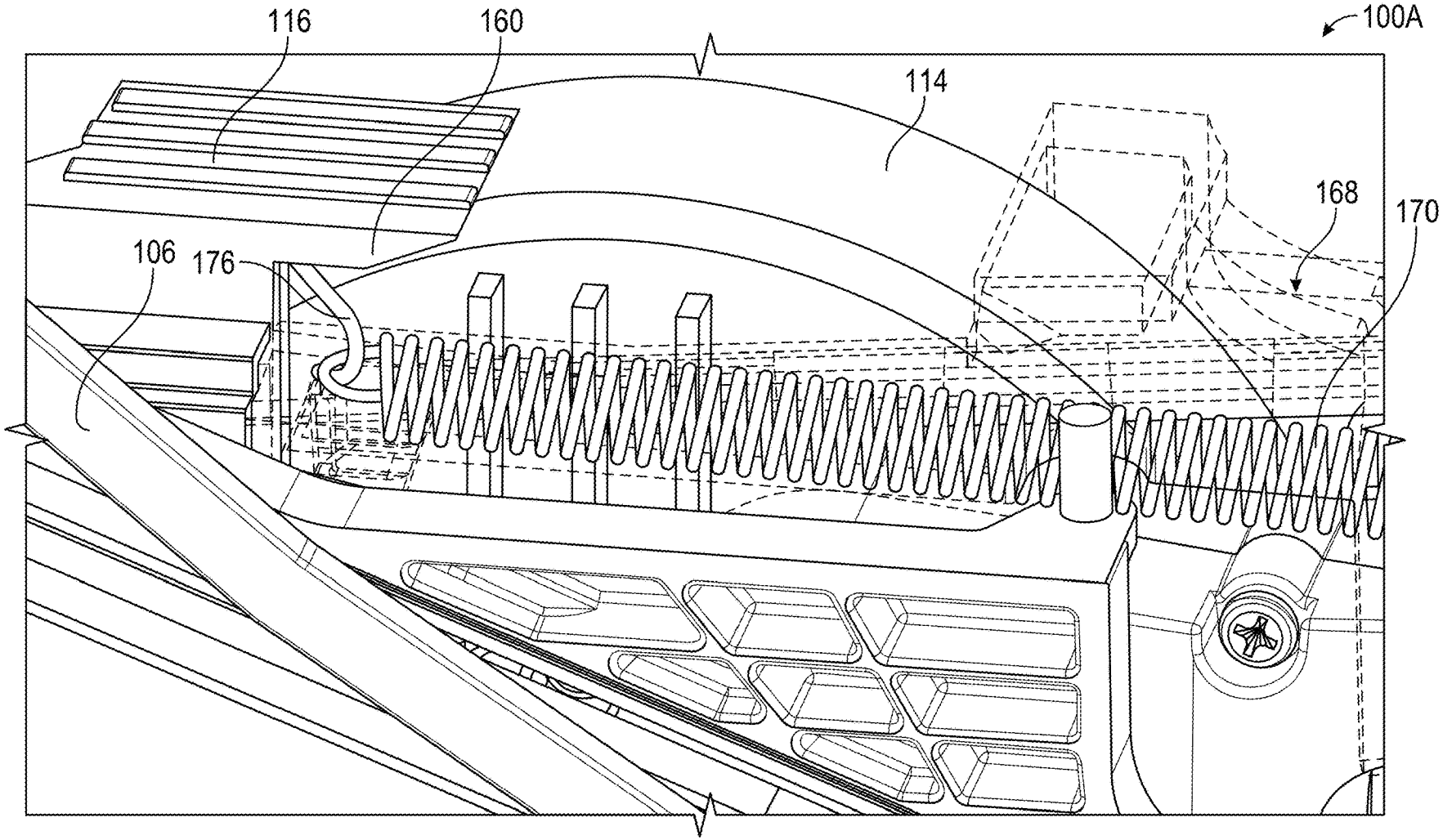
FIG. 8 illustrates an isometric view of a portion of a mobile cleaning robot.

FIG. 8 illustrates an isometric view of a portion of a mobile cleaning robot 100A. The mobile cleaning robot 100A of FIG. 8 can be similar to the mobile cleaning robot 100 of FIGS. 1A-7; the robot 100A can differ in that the wheel stop can include a spring hook 176. Any of the robots discussed above or below can be modified to include such a spring hook.

The spring hook 176 can extend from the top portion 160 of the wheel stop 116 and can be configured to connect to an end of the biasing element 170. Because the wheel stop 116 is movable with respect to the spring module 168 and therefor to the biasing element 170, movement of the wheel stop 116 can cause an adjustment of a spring force applied to the wheel 112. For example, when the wheel stop 116 is in the stop position (in vacuuming mode), the biasing element 170 can be stretched to a first position to set a first spring force applied to the wheel 112. Then, when the wheel stop 116 is moved the release position (in mopping mode), the biasing element 170 can be stretched to a second, further extended position to set a second spring force applied to the wheel 112, where the second spring force is greater than the first spring force. In this way, the spring force applied to the wheel 112 can be automatically adjusted or controlled based on the mode of the robot 100A.

In some examples, the controller 111 can be configured to further adjust the spring force when the wheel stop is in the vacuuming mode or in the mopping mode. For example, the wheel stop can have a range of translation in the mopping mode or the vacuuming mode and the controller 111 can move the wheel stop within the range of translation such that the wheel stop 116 remains in the same mode but adjusts the spring force by moving the hook 176. For example, when the wheel stop 116 is in the mopping mode, the controller 111 may move the wheel stop 116 to increase the spring force based on a floor surface type, mopping pad type, or other variable that can impact cleaning effectiveness. In this way, the controller can improve cleaning effectiveness by adjusting pressure on the cleaning pad assembly 108 by adjusting the spring force applied to the wheels 112.

Figure 9:
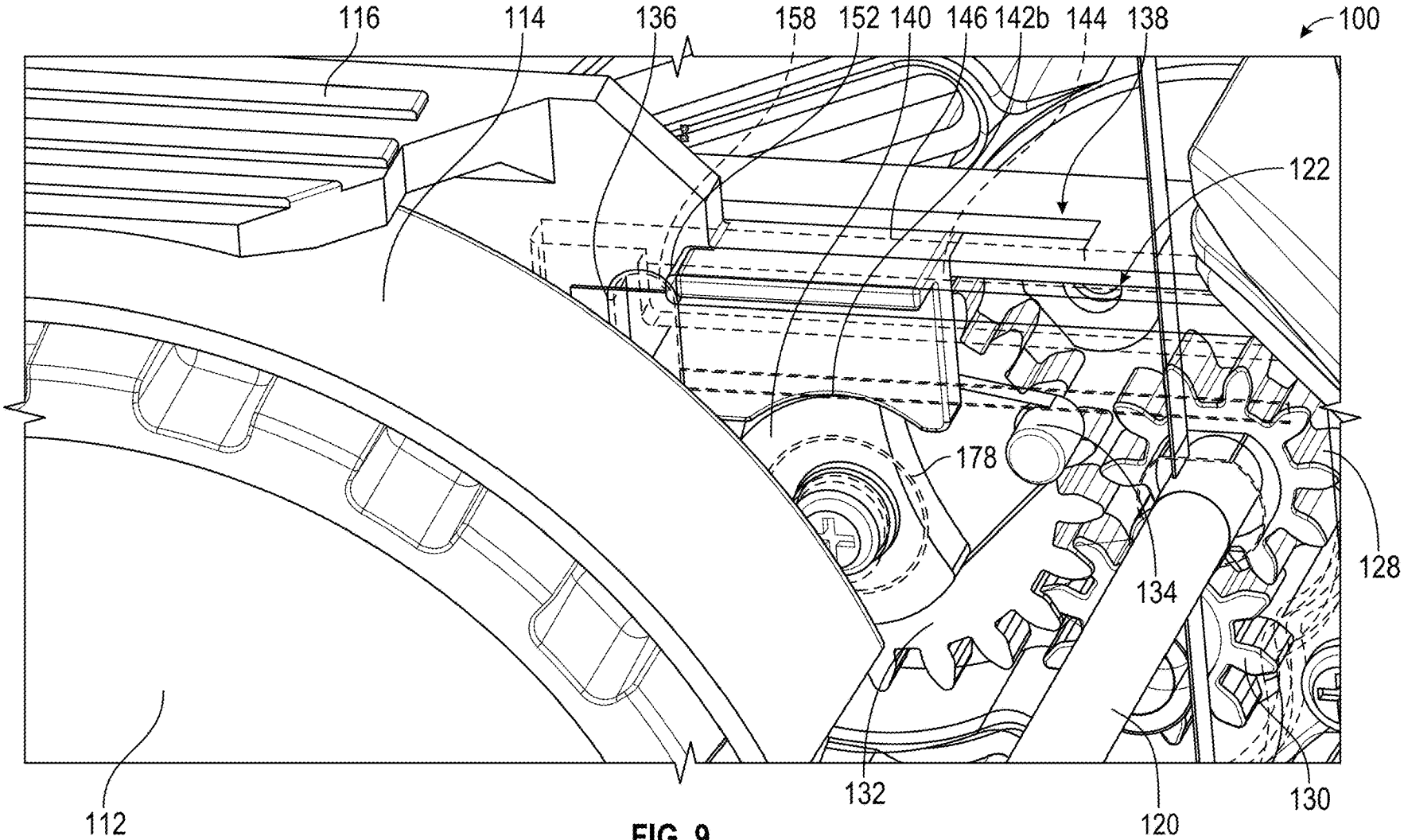
FIG. 9 illustrates an isometric view of a portion of a mobile cleaning robot.

FIG. 9 illustrates an isometric view of a portion of the mobile cleaning robot 100. The mobile cleaning robot 100 of FIG. 9 can be consistent with the mobile cleaning robot 100 of FIGS. 1A-7; FIG. 9 shows additional details of the robot 100. For example, FIG. 9 shows more clearly that the collar 140 can engage the support 142*b* of the wheel stop 116 when the wheel stop 116 is in the stop position (vacuuming mode). FIG. 9 also shows that the collar 140 can include a recessed portion 178 that can be located with respect to the boss 134 such that the wheel stop can pass by the collar 140 when the wheel stop 116 is being translated by the boss 134 engaging the slot 136, and such that the collar 140 supports the wheel stop 116 via the supports 142*a* or 142*b* after the wheel stop 116 passes the collar 140 during translation of the wheel stop 116 (between modes).

FIG. 9 also shows how the second end 152 of the guide 146 of the wheel stop 116 can engage the end 158 of the track 144 to limit motion of the wheel stop 116 towards the wheel 112 (forward) when the wheel stop 116 is moved to the stop position, such as when moving to the vacuuming mode.

Figure 10:
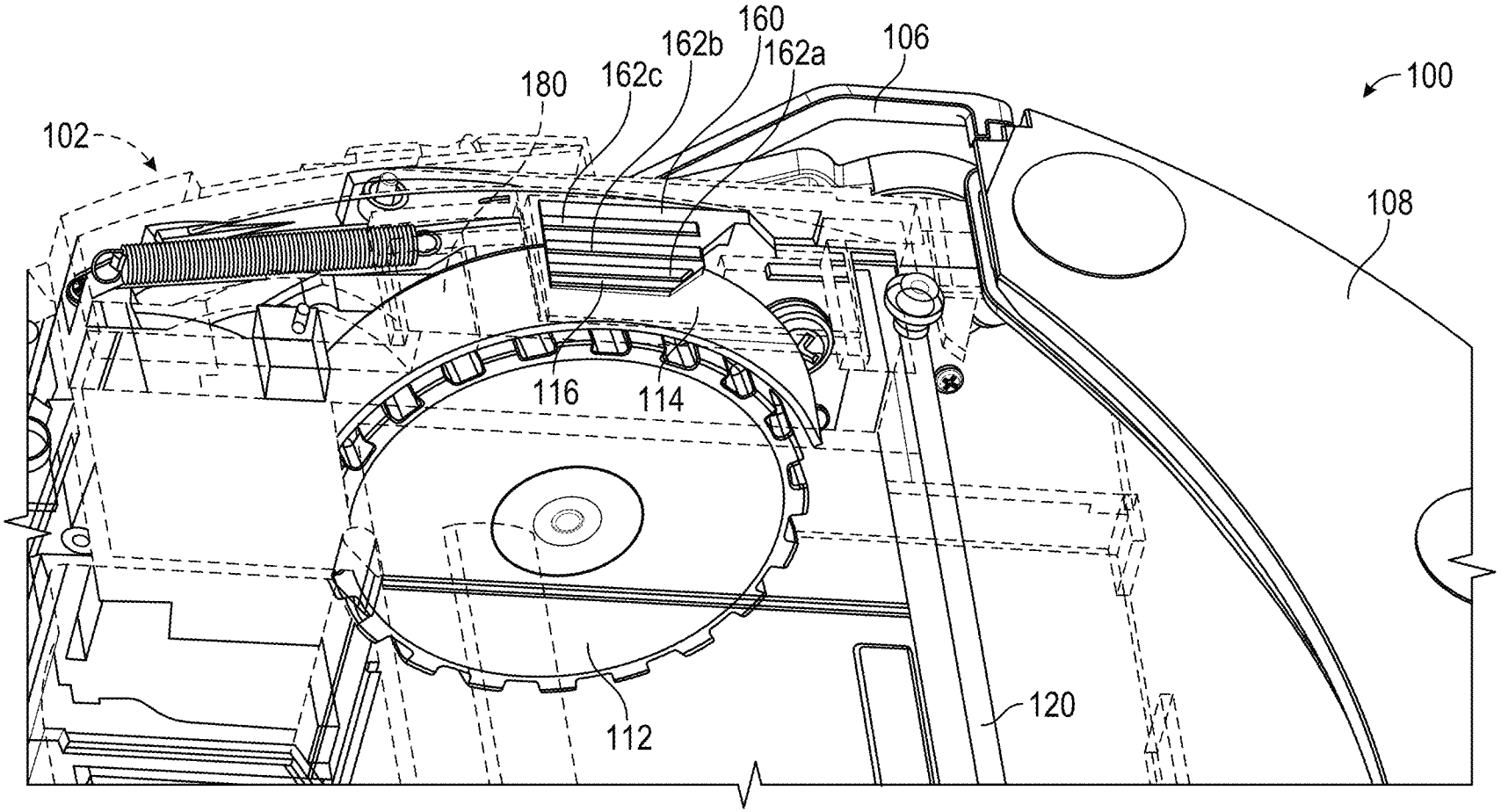
FIG. 10 illustrates an isometric view of a portion of a mobile cleaning robot.

FIG. 10 illustrates an isometric view of a portion of a mobile cleaning robot. The mobile cleaning robot 100 of FIG. 10 can be consistent with the mobile cleaning robot 100 of FIGS. 1A-7 and 9; FIG. 10 shows additional details of the robot 100. For example, FIG. 10 shows a portion 180 of the body 102 in phantom and shows how the ribs 162*a*-162*c* of the top portion 160 of the wheel stop 116 can engage the portion 180 of the body 102 to transfer forces between the fenders 114 and the body 102 when the wheel stop 116 is in the stop position, such as when the robot is in vacuuming mode.

Figure 11B:
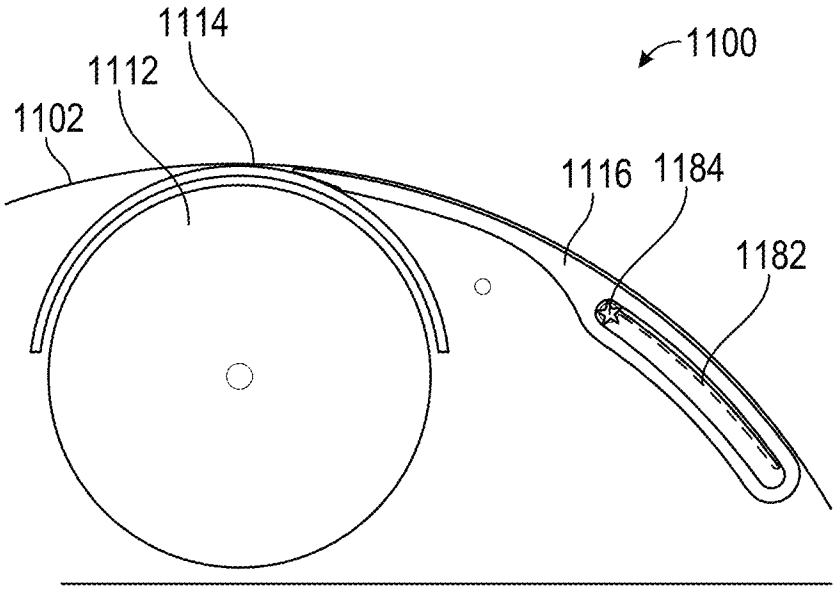
FIG. 11B illustrates an elevation view of a portion of a mobile cleaning robot.
Figure 11A:
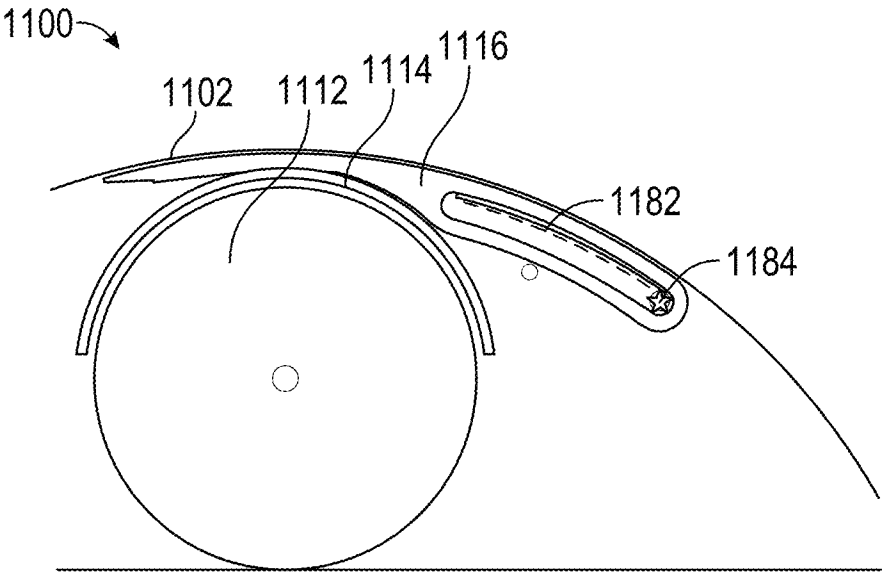
FIG. 11A illustrates an elevation view of a portion of a mobile cleaning robot.

FIG. 11A illustrates an elevation view of a portion of a mobile cleaning robot 1100. FIG. 11B illustrates an elevation view of a portion of the mobile cleaning robot 1100. FIGS. 11A and 11B are discussed together below. The mobile cleaning robot 1100 of FIGS. 11A and 11B can be similar to the mobile cleaning robot 100 of FIGS. 1-10; the robot 1100 can differ in that the wheel stop of the robot 1100 can be on a rack and pinion system. Any of the robots discussed above or below can be modified to include a wheel stop on a rack and pinion system.

More specifically, the robot 1100 can include a body 1102, a drive wheel 1112, a fender 1114, and a wheel stop 1116. The wheel stop 1116 can be curved or can be shaped to match an underside of the body 1102 of the robot 1100, such as to save space within the body 1102 of the robot. The wheel stop can be connected to a rack 1182, which can be positioned in a slot or groove of the wheel stop 1116. The rack 1182 can be engaged with a pinion 1184 where the pinion 1184 can be driven to rotate by a drive system (such as the drive system 118 of the robot 100). The drive system can operate the pinion 1184 to move the rack 1182 and therefore the wheel stop 1116, such as between a stop position (shown in FIG. 11A) where the wheel stop 1116 is engaged with the fender 1114 and a release position (shown in FIG. 11B). The rack 1182 and pinion 1184 can help to provide a robust and reliable mechanism for translating or moving the wheel stop 1116 with respect to the fender 1114.

Figure 12:
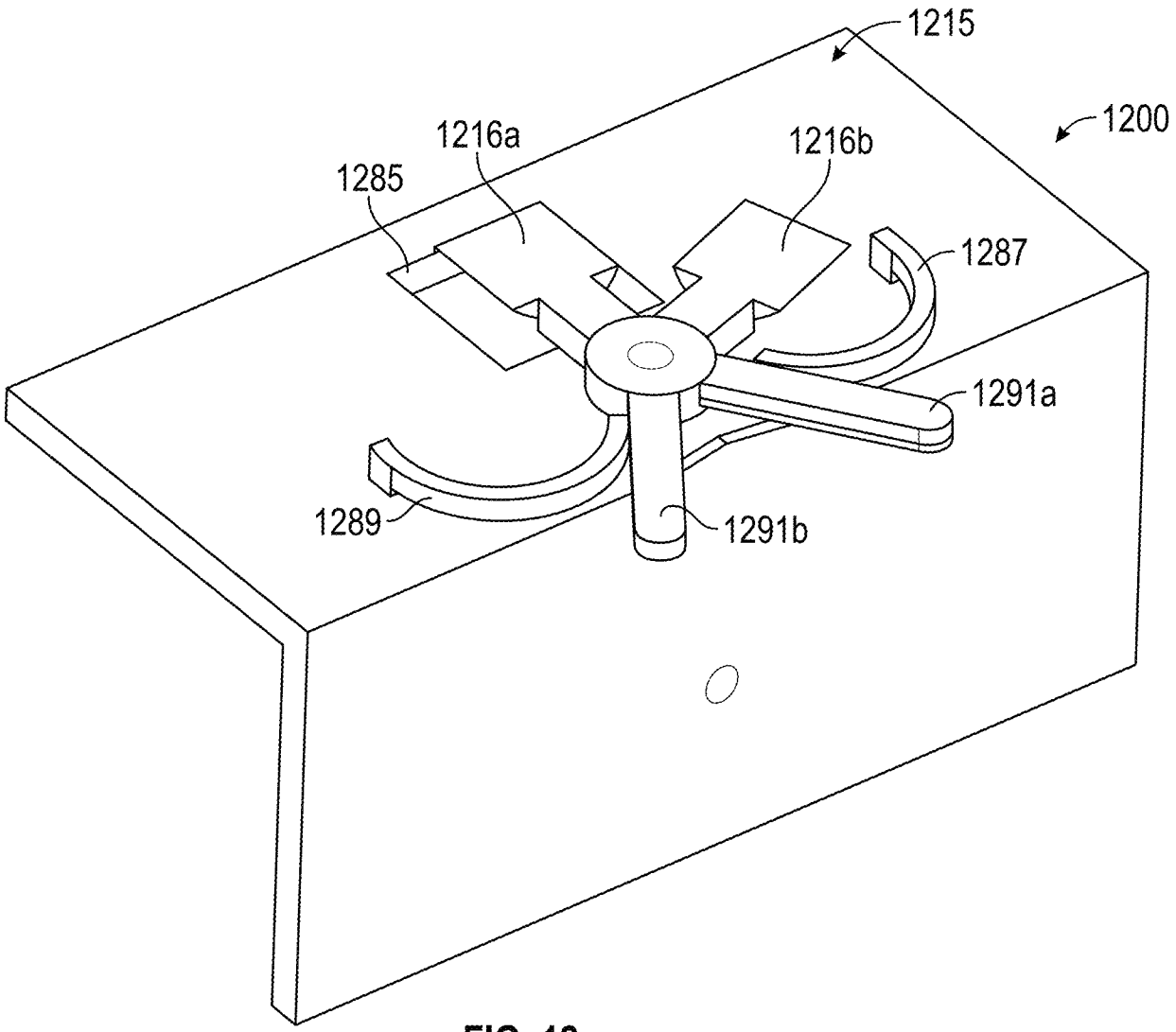
FIG. 12 illustrates an isometric view of a portion of a mobile cleaning robot.

FIG. 12 illustrates an isometric view of a portion of a mobile cleaning robot. The mobile cleaning robot 1200 of FIG. 12 can be similar to the mobile cleaning robot 100 of FIGS. 1-10; the robot 1200 can differ in that the wheel stop can rotate instead of translate. Any of the robots discussed above or below can be modified to include such a rotating wheel stop.

More specifically, the robot 1200 can include a wheel stop assembly 1215 including a wheel stop 1216. The wheel stop 1216 can include an arm 1291 configured to contact stops 1287 and 1289 of the assembly 1215. The wheel stop assembly 1215 can also include a window 1285 configured to receive a portion of the fender therein in the mopping mode (when the wheel stop 1216 is rotated to the position 1216*b*). Such rotation can be limited by contact between the arm 1291 and the stop 1289. When the wheel stop 1216 is in such a position, the vertical wheel travel can be limited by contact between the fender and the assembly 1215, such as near the window 1285.

The wheel stop 1216 can be rotatable to the position indicated by 1216*a* where rotation can be limited by contact between the arm 1291 and the stop 1287. In the position of 1216*a*, the wheel stop 1216 can contact the fender through the window 1285 to limit the wheel travel when the robot 1200 is in the vacuuming mode.

Figure 13A:
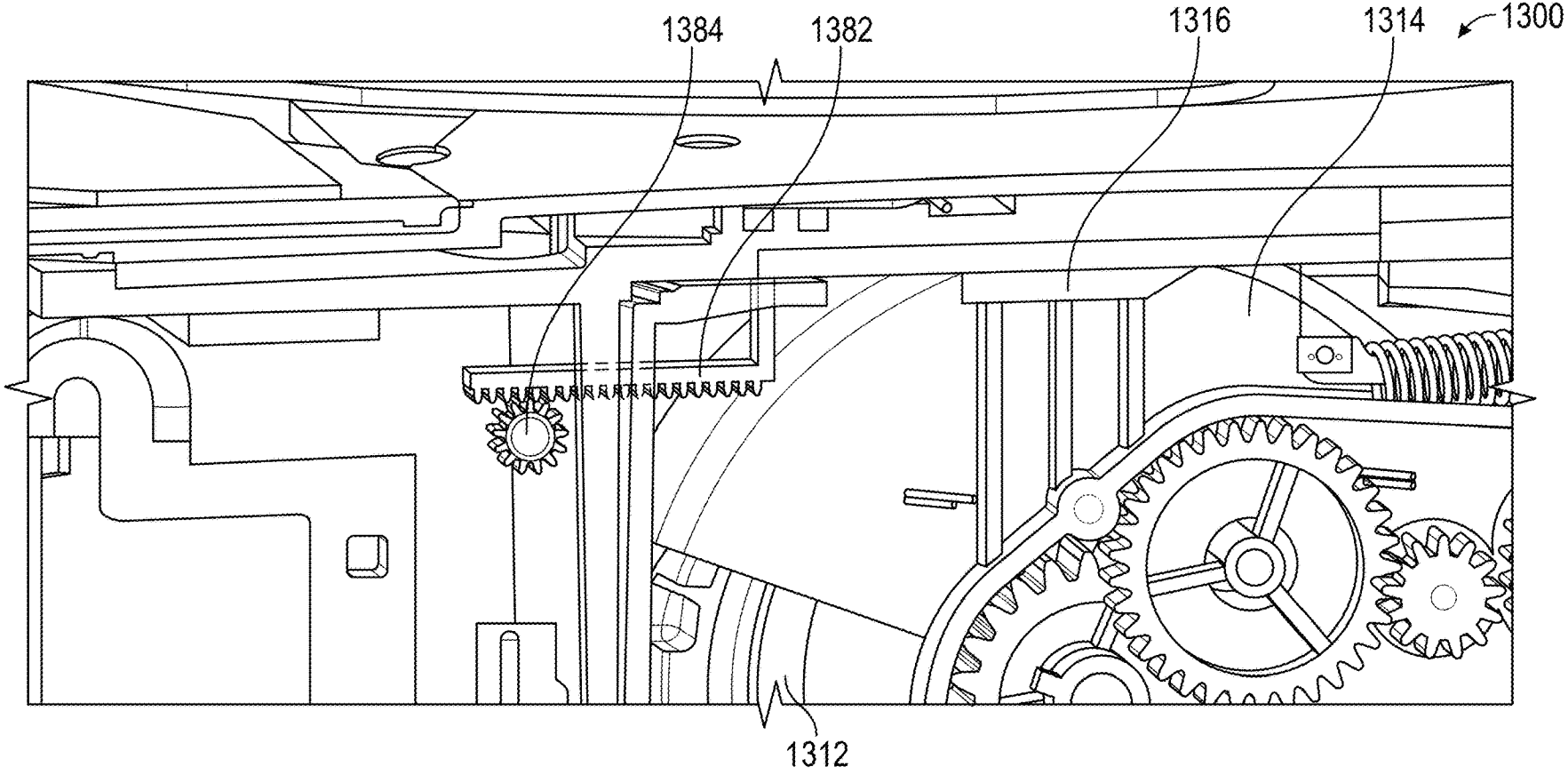
FIG. 13A illustrates an isometric view of a portion of a mobile cleaning robot.
Figure 13B:
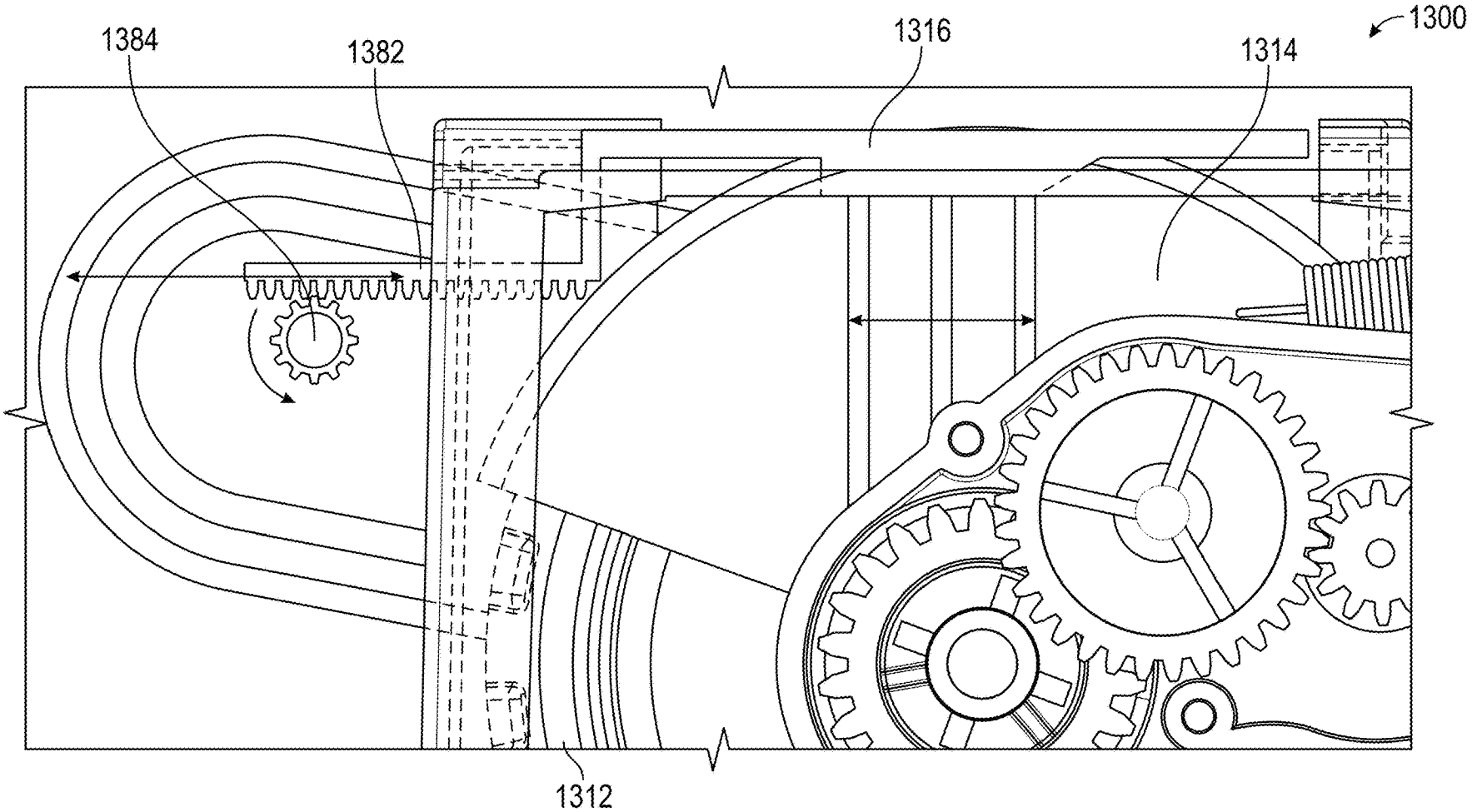
FIG. 13B illustrates an isometric view of a portion of a mobile cleaning robot.

FIG. 13A illustrates an isometric view of a portion of a mobile cleaning robot. FIG. 13B illustrates an isometric view of a portion of the mobile cleaning robot 1300. FIGS. 13A and 13B are discussed together below. The mobile cleaning robot 1300 of FIGS. 13A and 13B can be similar to the mobile cleaning robot 100 of FIGS. 1A-10; the robot 1300 can differ in that the robot can include a rack and pinion wheel stop system. Any of the robots discussed above or below can be modified to include a rack and pinion wheel stop system.

More specifically, the robot 1300 can include a drive wheel 1312, a fender 1314, and a wheel stop 1316. The wheel stop 1316 can be connected to a rack 1382, which can be located at least partially within a body of the robot 1300. The rack 1382 can be engaged with a pinion 1384 where the pinion 1384 can be driven to rotate by a drive system (such as the drive system 118 of the robot 100). The drive system can operate the pinion 1384 to move (e.g., translate) the rack 1382 and therefore the wheel stop 1316, such as between a stop position (shown in FIGS. 13A-13B) where the wheel stop 1116 is engageable with the fender 1314 and between a release position. The rack 1382 and pinion 1384 can help to provide a robust and reliable mechanism for translating or moving the wheel stop 1316 with respect to the fender 1314 to adjust wheel travel of the wheels 1312 depending on an operating mode (e.g., vacuuming mode or cleaning/mopping mode) of the robot 1300.

Figure 14A:
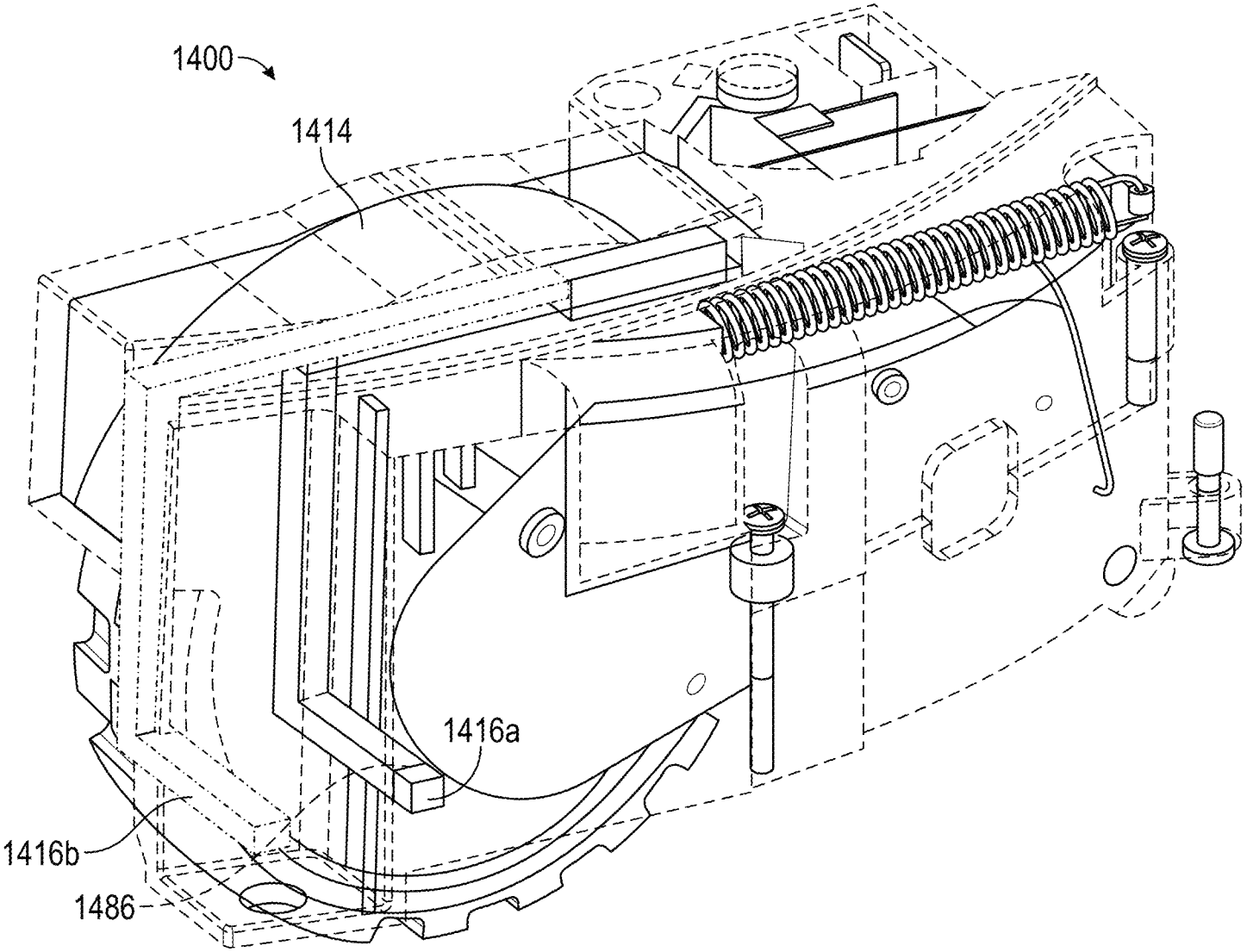
FIG. 14A illustrates an isometric view of a portion of a mobile cleaning robot.
Figure 14B:
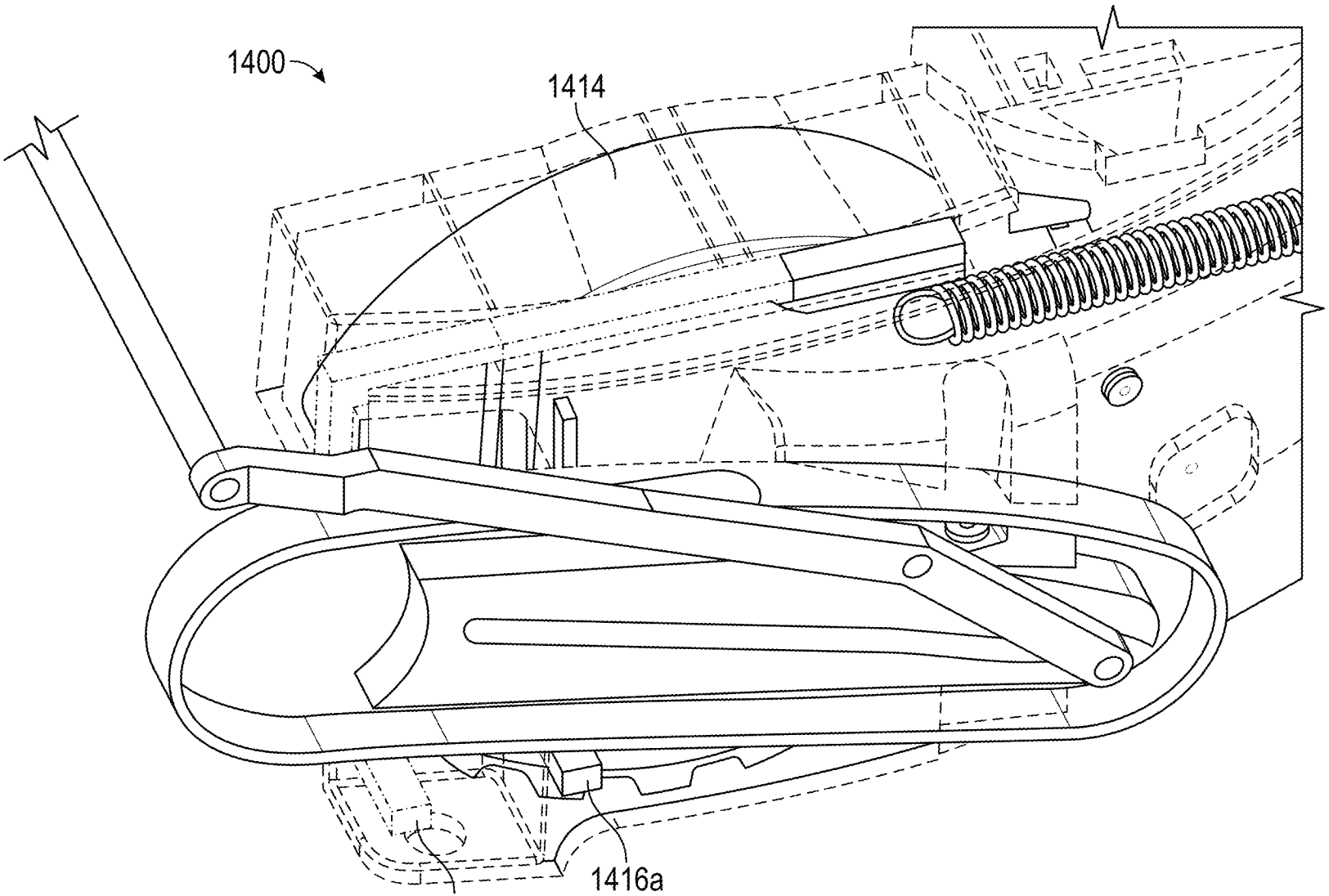
FIG. 14B illustrates an isometric view of a portion of a mobile cleaning robot.

FIG. 14A illustrates an isometric view of a portion of a mobile cleaning robot. FIG. 14B illustrates an isometric view of a portion of a mobile cleaning robot. FIGS. 14A and 14B are discussed together below. The mobile cleaning robot 1400 of FIGS. 14A-14B can be similar to the mobile cleaning robot 100 of FIGS. 1A-10; the robot 1400 can differ in that the wheel stop can be a translating bar activated by the arms of the mopping pad to help ensure that the wheel stops are activated when the mopping assembly is under the body of the robot 1400. Any of the robots discussed above or below can be modified to include such a wheel stop.

More specifically, the robot 1400 can include a fender 1414 that is secured to a wheel stop 1416. The wheel stop 1416*b* can be engageable with a stop 1486 when the stop 1416 is in the mobility or stop position as indicated by 1416*a*. When the stop 1416 is not in the release position (as indicated by 1416*b*), the wheel stop 1416 does not engage the stop 1486. The wheel stop 1416 can be translated between the stop position and the release position by a drive system (such as the drive system 118 of robot 100).

Figure 15A:
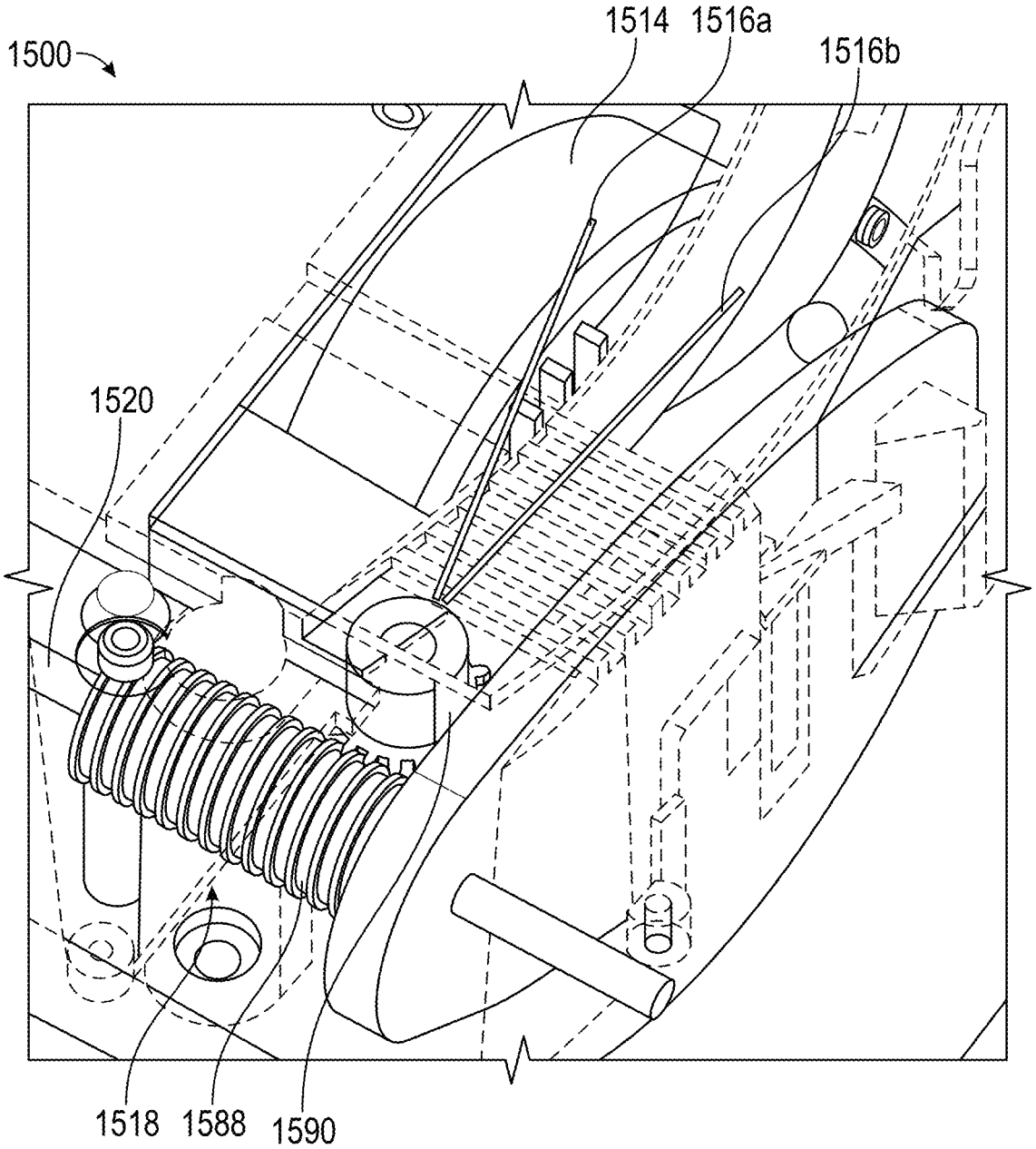
FIG. 15A illustrates an isometric view of a portion of a mobile cleaning robot.
Figure 15B:
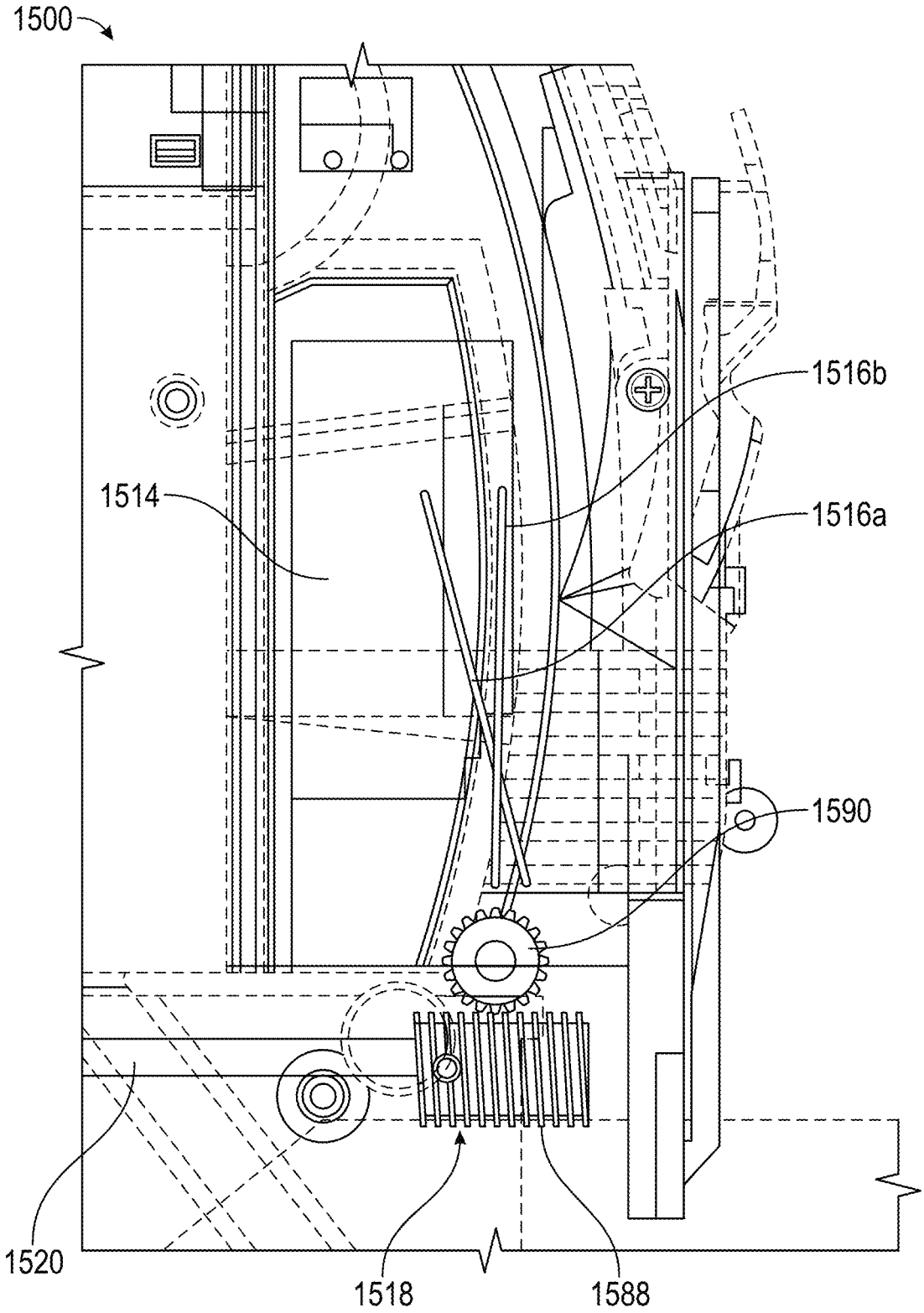
FIG. 15B illustrates an isometric view of a portion of a mobile cleaning robot.

FIG. 15A illustrates an isometric view of a portion of a mobile cleaning robot. FIG. 15B illustrates an isometric view of a portion of a mobile cleaning robot. FIGS. 15A and 15B are discussed together below. The mobile cleaning robot 1400 of FIGS. 15A and 15B can be similar to the mobile cleaning robot 100 of FIGS. 1A-10; the robot 1500 can differ in that the drive system can include a worm gear and the wheel stop can rotate. Any of the robots discussed above or below can be modified to include such a drive system and wheel stop.

More specifically, the robot 1500 can include a wheel stop 1516 that can rotate between a stop position, as indicated by 1516*a* and a release position, as indicated by 1516*b*. The wheel stop 1516 can be driven to rotate by a cross-shaft 1520 connected to a worm drive 1588 and a worm gear 1590 of a drive system 1518, where the worm drive 1588 and the worm gear 1590 can be engaged to rotate the wheel stop 1516 between the stop position and the release position to adjust engagement between a fender 1514 and the wheel stop 1516 to control vertical wheel travel in the vacuuming mode and the mopping mode.

Figure 16A:
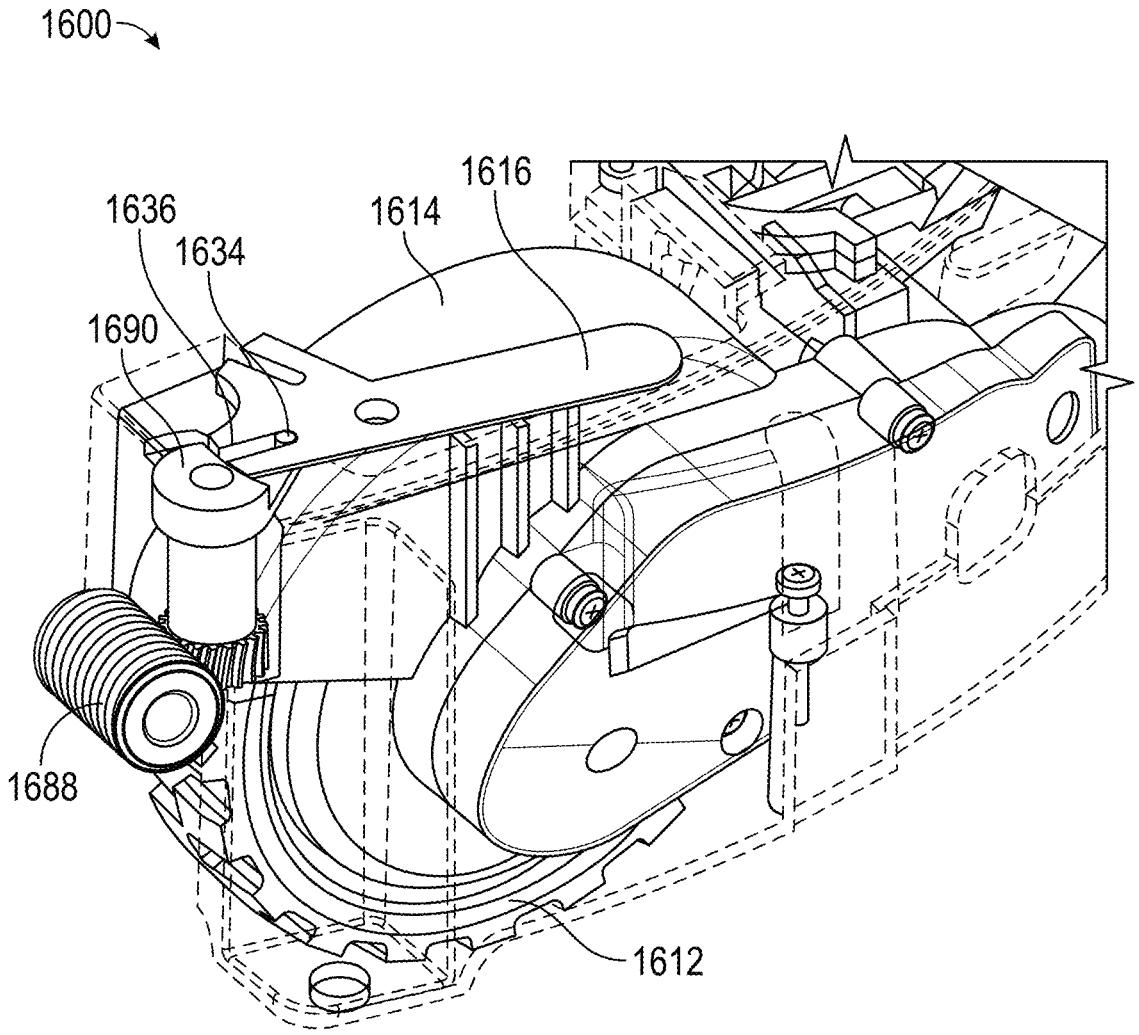
FIG. 16A illustrates an isometric view of a portion of a mobile cleaning robot.
Figure 16B:
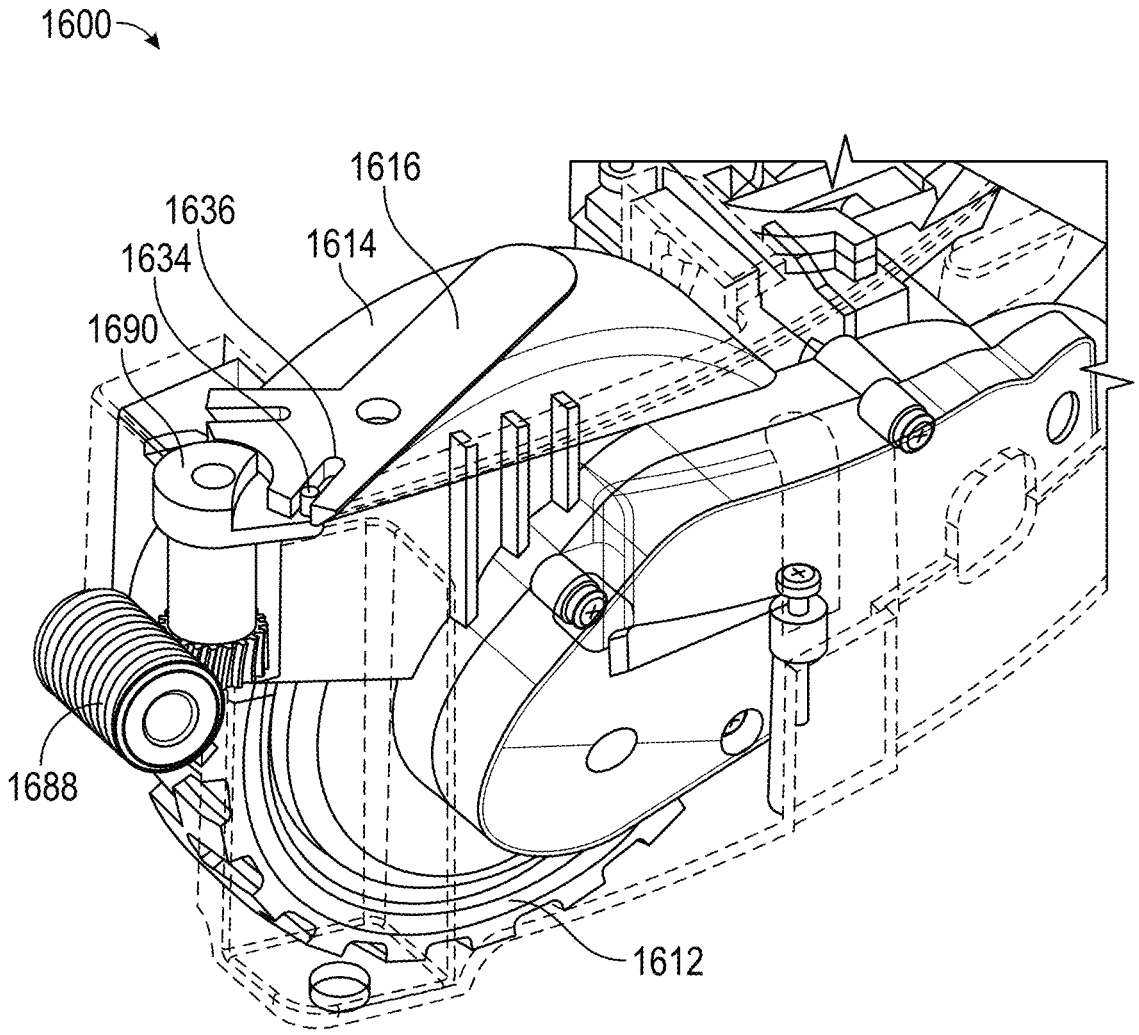
FIG. 16B illustrates an isometric view of a portion of a mobile cleaning robot.

FIG. 16A illustrates an isometric view of a portion of a mobile cleaning robot. FIG. 16B illustrates an isometric view of a portion of a mobile cleaning robot. FIGS. 16A and 16B are discussed together below. The mobile cleaning robot 1600 of FIGS. 16A and 16B can be similar to the mobile cleaning robot 100 of FIGS. 1-10; the robot 1600 can differ in that the wheel stop can be driven to rotate by a Geneva gear. Any of the robots discussed above or below can be modified to include such a wheel stop and gear system.

More specifically, the robot 1600 can include a wheel stop 1616 that can rotate between a stop position (shown in FIG. 16B) and a release position (shown in FIG. 16A). The wheel stop 1616 can be driven to rotate by a worm drive 1688 and a worm gear 1690 including a boss 1634, such as to form a Geneva gear or mechanism. The wheel stop 1616 can include a slot 1636 to receive the boss 1634 therein. The worm drive 1688 and the worm gear 1690 can be engaged to rotate the boss 1634 to move within the slot 1636 to cause the wheel stop 1616 to rotate between the stop position and the release position to adjust engagement between a fender 1614 and the wheel stop 1616 to control vertical wheel travel in the vacuuming mode and the cleaning/mopping mode.

Figure 17A:
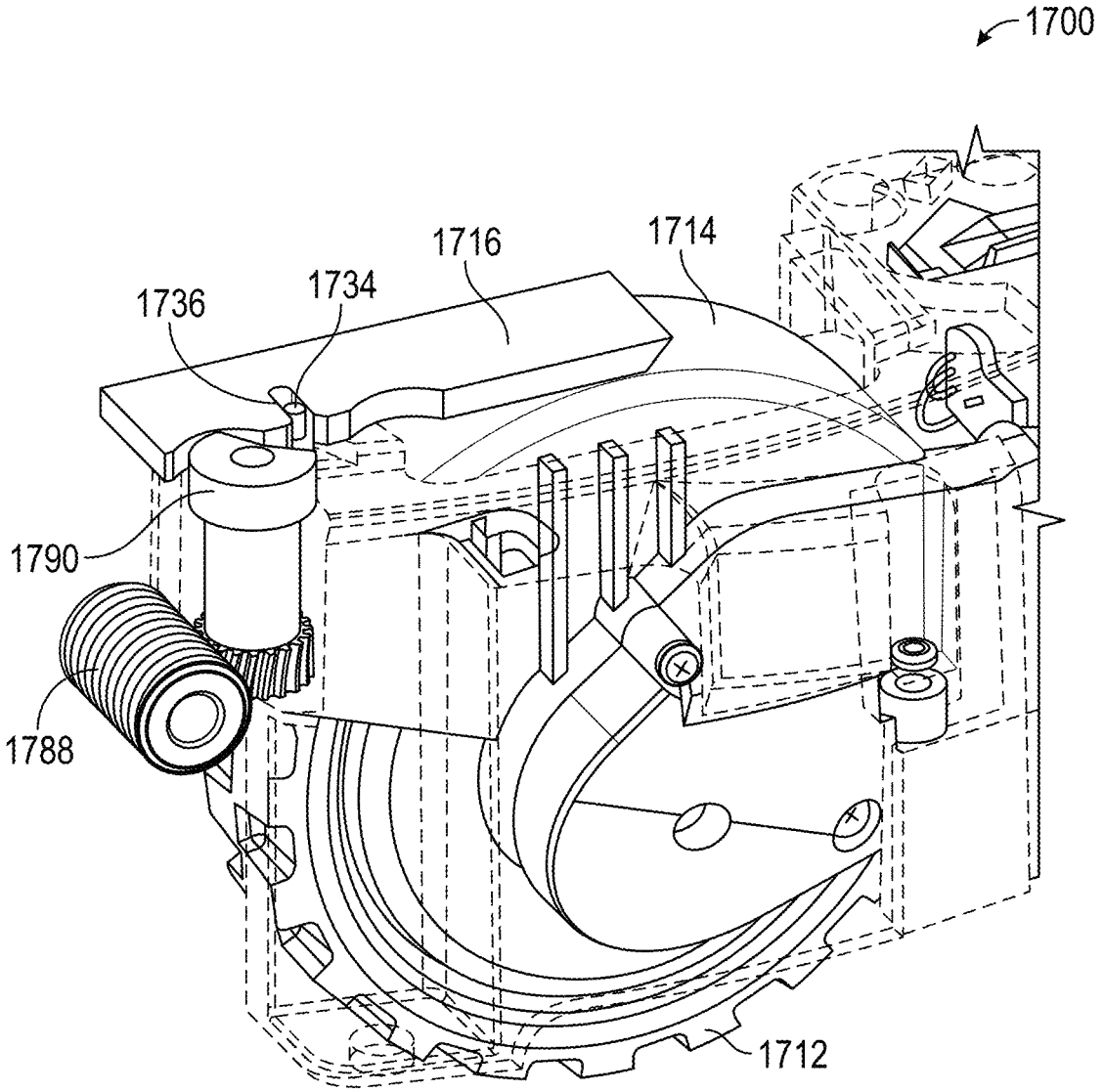
FIG. 17A illustrates an isometric view of a portion of a mobile cleaning robot.
Figure 17B:
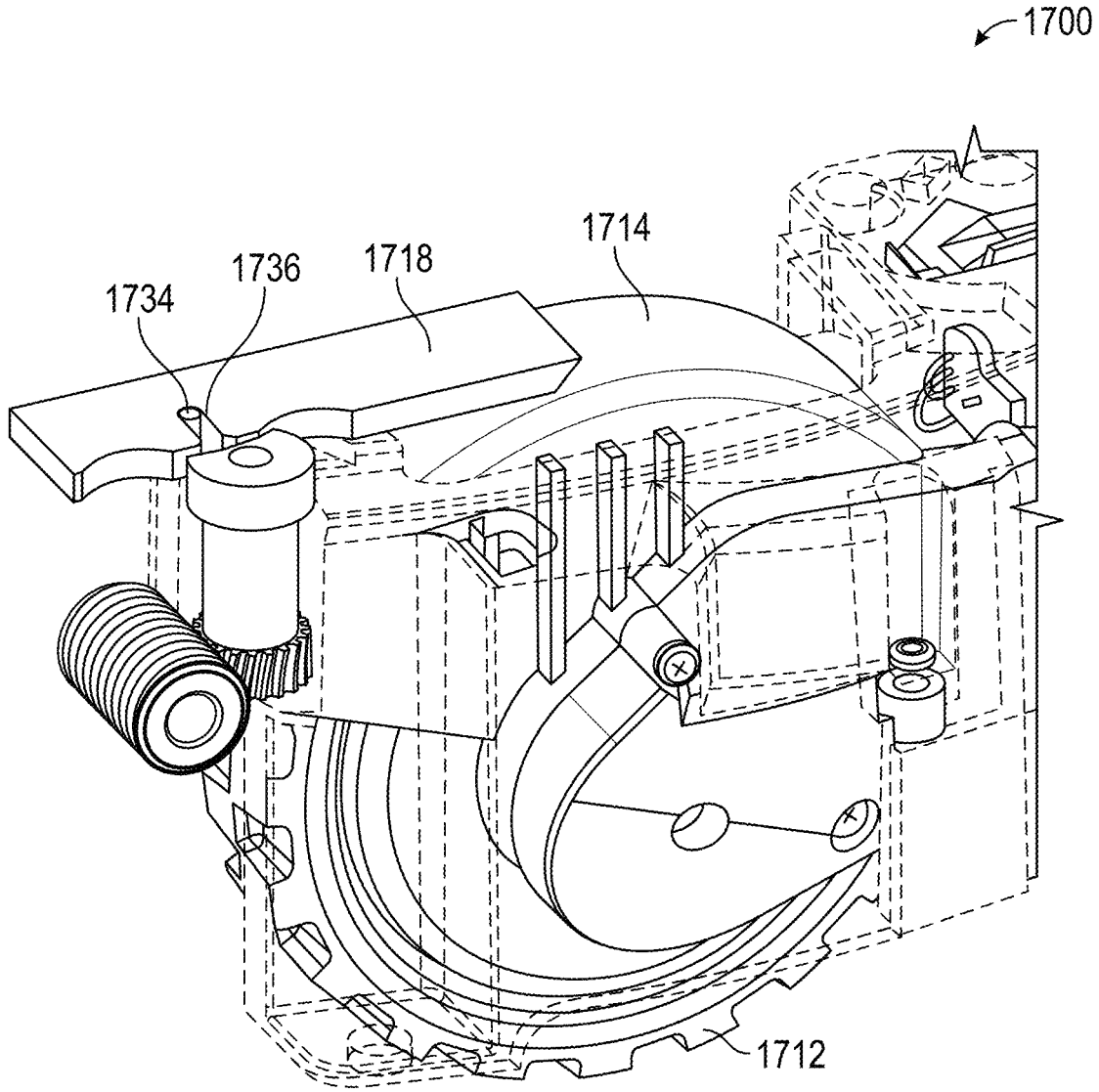
FIG. 17B illustrates an isometric view of a portion of a mobile cleaning robot.

FIG. 17A illustrates an isometric view of a portion of a mobile cleaning robot. FIG. 17B illustrates an isometric view of a portion of a mobile cleaning robot. FIGS. 17A and 17B are discussed together below. The mobile cleaning robot 1700 of FIGS. 17A and 17B can be similar to the mobile cleaning robot 100 of FIGS. 1-10; the robot 1700 can differ in that the wheel stop can be driven to translate by worm drive and a Geneva gear. Any of the robots discussed above or below can be modified to include such a wheel stop and gear system.

More specifically, the robot 1700 can include a wheel stop 1716 that can translate between a stop position (shown in FIG. 17A) and a release position (shown in FIG. 17B). The wheel stop 1716 can be driven to translate by a worm drive 1788 and a worm gear 1790 including a boss 1734, such as to form a Geneva gear or mechanism. The wheel stop 1716 can include a slot 1736 to receive the boss 1734 therein. The worm drive 1788 and the worm gear 1790 of a drive system 1718 can be engaged to rotate the boss 1734 to move within the slot 1736 to cause the wheel stop 1716 to translate between the stop position and the release position to adjust engagement between a fender 1714 and the wheel stop 1716 to control vertical wheel travel in the vacuuming mode and the cleaning/mopping mode. The wheel stop 1716 can optionally include notches or cutouts for passing (translating past) the worm gear 1790.

Figure 18A:
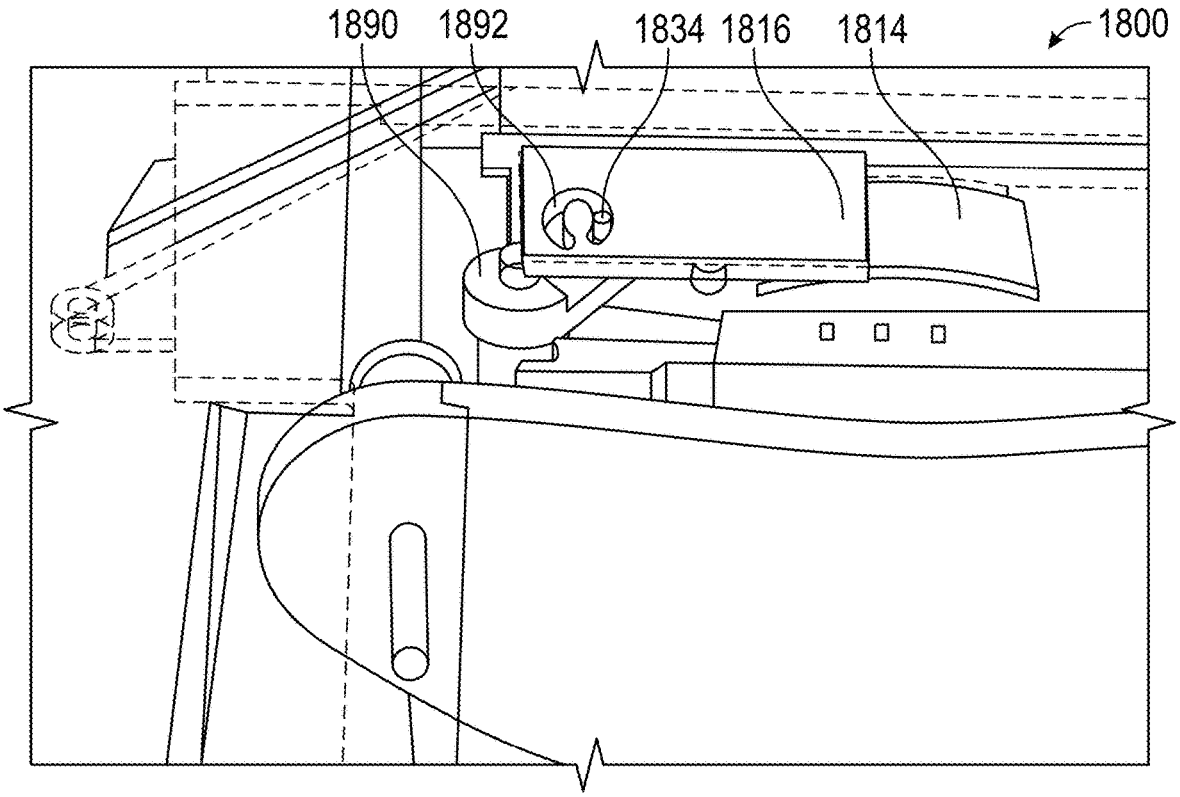
FIG. 18A illustrates an isometric view of a portion of a mobile cleaning robot.
Figure 18B:
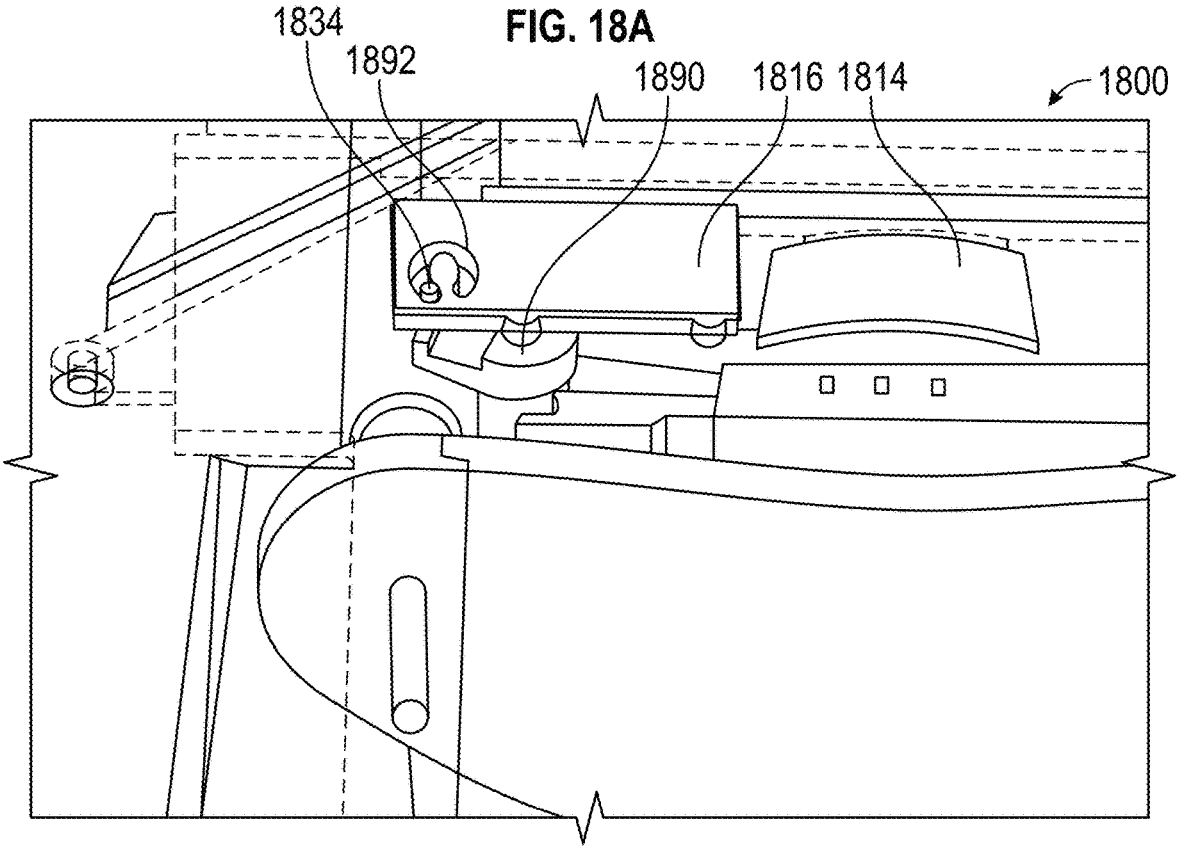
FIG. 18B illustrates an isometric view of a portion of a mobile cleaning robot.

FIG. 18A illustrates an isometric view of a portion of a mobile cleaning robot. FIG. 18B illustrates an isometric view of a portion of a mobile cleaning robot. FIGS. 18A and 18B are discussed together below. The mobile cleaning robot 1800 of FIGS. 18A and 18B can be similar to the mobile cleaning robot 100 of FIGS. 1A-10; the robot 1800 can differ in that the wheel stop can be driven to translate by worm drive and a Geneva gear. Any of the robots discussed above or below can be modified to include such a wheel stop and gear system.

More specifically, the robot 1800 can include a wheel stop 1816 that can translate between a stop position (shown in FIG. 18A) and a release position (shown in FIG. 18B). The wheel stop 1816 can be driven to translate by a worm drive 1888 and a worm gear 1890 including a boss 1834, such as to form a Geneva gear or mechanism. The wheel stop 1816 can include a slot 1892 to receive the boss 1834 therein. The track 1892 can be curved or arced to cause the translation of the wheel stop 1816 in response to rotation of the boss 1834 and the worm gear 1890.

The worm drive 1888 and the worm gear 1890 can be engaged to rotate the boss 1834 to move within the track 1892 to cause the wheel stop 1816 to translate between the stop position and the release position to adjust engagement between a fender 1814 and the wheel stop 1816 to control vertical wheel travel in the vacuuming mode and the mopping mode. The wheel stop 1816 can optionally include notches or cutouts for passing (translating past) the worm gear 1890.

NOTES AND EXAMPLES

The following, non-limiting examples, detail certain aspects of the present subject matter to solve the challenges and provide the benefits discussed herein, among others.

Example 1 is a mobile cleaning robot comprising: a body; a drive wheel connected to the body and operable to move the mobile cleaning robot about an environment; and a wheel stop movable with respect to the body and the drive wheel between a stop position and a release position, the wheel stop engageable with the drive wheel in the stop position to limit vertical travel of the drive wheel with respect to the body.

In Example 2, the subject matter of Example 1 optionally includes a gear assembly connected to the wheel stop, the gear assembly operable to translate the wheel stop with respect to the wheel in response to rotational input.

In Example 3, the subject matter of Example 2 optionally includes a drive system operable to operate the gear assembly.

In Example 4, the subject matter of Example 3 optionally includes wherein the drive system is operable to change a mode of the mobile cleaning robot between a vacuuming mode and a mopping mode.

In Example 5, the subject matter of Example 4 optionally includes a pad assembly connected to the body and movable relative to the body between a stored position and a mopping position.

In Example 6, the subject matter of Example 5 optionally includes wherein the drive system is connected to the pad assembly and operable to move the pad assembly between the stored position in the vacuuming mode and the mopping position in the mopping mode.

In Example 7, the subject matter of Example 6 optionally includes wherein the gear assembly includes a timing mechanism to move the wheel stop at a desired position of the pad assembly.

In Example 8, the subject matter of Example 7 optionally includes wherein the timing mechanism is a Geneva mechanism.

In Example 9, the subject matter of any one or more of Examples 7-8 optionally include wherein the timing mechanism is configured to begin moving the wheel stop when or after the pad assembly engages a floor surface.

In Example 10, the subject matter of any one or more of Examples 2-9 optionally include wherein the body includes a track engageable with a guide of the wheel stop, the track engageable with the guide of the wheel stop to limit vertical and horizontal translation of the wheel stop with respect to the body and the drive wheel.

In Example 11, the subject matter of any one or more of Examples 1-10 optionally include wherein a bottom portion of the wheel stop is engageable with a fender surrounding at least a portion of the drive wheel of the robot when the wheel stop is in the stop position, and wherein a top portion of the wheel stop is engageable with the body when the wheel stop is in the stop position.

In Example 12, the subject matter of Example 11 optionally includes wherein the top portion of the wheel stop includes a plurality of ribs engageable with the body when the wheel stop is in the stop position.

Example 13 is a mobile cleaning robot comprising: a body; a pair of drive wheels operable to move the mobile cleaning robot in an environment; and a pair of wheel stops movable with respect to the body and the drive wheels between a stop position and a release position, the wheel stops engageable with respective drive wheels in the stop position to limit vertical travel of the drive wheel with respect to the body.

In Example 14, the subject matter of Example 13 optionally includes a pad assembly connected to the body and movable relative to the body between a stored position and a mopping position.

In Example 15, the subject matter of Example 14 optionally includes a gear assembly connected to the wheel stop, the gear assembly operable to translate the wheel stop with respect to the wheel in response to rotational input.

In Example 16, the subject matter of Example 15 optionally includes a drive system operable to operate the gear assembly.

In Example 17, the subject matter of Example 16 optionally includes wherein the drive system is connected to the pad assembly and operable to move the pad assembly between the stored position and the mopping position.

In Example 18, the subject matter of Example 17 optionally includes wherein the gear assembly includes a timing mechanism to move the wheel stop at a desired position of the pad assembly.

Example 19 is a mobile cleaning robot comprising: a body; a drive system connected to the body and including a drive wheel; a wheel stop movable with respect to the body and the drive wheel between a stop position and a release position, the wheel stop engageable with the drive wheel in the stop position to limit travel of the drive wheel with respect to the body; and a controller connected to the body and configured to: move the wheel stop based on where a pad assembly is located between a stored position and a mopping position.

In Example 20, the subject matter of Example 19 optionally includes wherein the pad assembly is connected to the body and movable relative to the body between a stored position and a mopping position.

In Example 21, the subject matter of Example 20 optionally includes a gear assembly connected to the wheel stop, the gear assembly operable to translate the wheel stop with respect to the wheel in response to rotational input.

In Example 22, the subject matter of Example 21 optionally includes a cross-shaft connected to the gear assembly; and a motor connected to the cross-shaft and in communication with the controller, the motor operable to rotate the cross-shaft to operate the gear assembly.

In Example 23, the apparatuses or method of any one or any combination of Examples 1-22 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot comprising:

a body;

a drive wheel connected to the body and operable to move the mobile cleaning robot in an environment;

a fender surrounding at least a portion of the drive wheel;

a wheel stop movable with respect to the body and the drive wheel between a stop position and a release position, the wheel stop engageable with the fender in the stop position to limit vertical travel of the drive wheel with respect to the body; and a drive system comprising a motor operable to move the wheel stop to change a mode of the mobile cleaning robot between a vacuuming mode and a mopping mode.

2. The mobile cleaning robot of claim 1, further comprising:

a pad assembly connected to the body and the drive system, the drive system operable to move the pad assembly relative to the body between a stored position and a mopping position.

3. The mobile cleaning robot of claim 2, further comprising:

a gear assembly connected to the wheel stop and the drive system, the gear assembly operable to translate the wheel stop with respect to the drive wheel in response to rotational input from the drive system.

4. The mobile cleaning robot of claim 3, wherein the gear assembly includes a timing gear to move the wheel stop when the pad assembly is at a desired position.

5. The mobile cleaning robot of claim 4, wherein the timing gear is configured to begin moving the wheel stop when or after the pad assembly engages a floor surface.

6. The mobile cleaning robot of claim 4, wherein the timing gear is a Geneva mechanism.

7. The mobile cleaning robot of claim 2, further comprising:

a Geneva gear connected to the drive system and selectively engageable with the wheel stop to move the wheel stop between the stop position and the release position.

8. The mobile cleaning robot of claim 7, wherein the Geneva gear includes a boss and wherein the wheel stop includes a slot configured to receive the boss at least partially therein.

9. The mobile cleaning robot of claim 8, wherein the boss is configured to rotate around the Geneva gear and enters the slot to move the wheel stop between the stop position and the release position.

10. The mobile cleaning robot of claim 9, wherein the boss is configured to enter the slot to move the wheel stop to the stop position when the drive system moves the pad assembly to the stored position and is configured to enter the slot to move the wheel stop to the release position when the drive system moves the pad assembly to the release position.

11. The mobile cleaning robot of claim 1, wherein a bottom portion of the wheel stop is engageable with a fender surrounding at least a portion of the drive wheel of the mobile cleaning robot when the wheel stop is in the stop position, and wherein a top portion of the wheel stop is engageable with the body when the wheel stop is in the stop position.

12. A mobile cleaning robot comprising:

a body;

a pair of drive wheels operable to move the mobile cleaning robot in an environment;

a pair of fenders each surrounding at least a portion of a respective one of the pair of drive wheels;

a pair of wheel stops movable with respect to the body and the pair of drive wheels between a stop position and a release position, the pair of wheel stops respectively engageable with the pair of fenders in the stop position to limit vertical travel of the pair of drive wheels with respect to the body; and a drive system comprising a motor operable to move the pair of wheel stops to the stop position in a vacuuming mode and to move the pair of wheel stops to the release position in a mopping mode.

13. The mobile cleaning robot of claim 12, further comprising:

a pad assembly connected to the body and the drive system, the drive system operable to move the pad assembly relative to the body between a stored position and a mopping position.

14. The mobile cleaning robot of claim 13, wherein the drive system is configured to move the pair of wheel stops to the stop position when the drive system moves the pad assembly to the stored position.

15. The mobile cleaning robot of claim 14, wherein the drive system is configured to move the pair of wheel stops to the release position when the drive system moves the pad assembly to the mopping position.

16. The mobile cleaning robot of claim 15, further comprising:

a one or more gear assemblies connected to the pair of wheel stops and the drive system, the one or more gear assemblies operable to translate the pair of wheel stops with respect to the pair of drive wheels in response to rotational input from the drive system.

17. The mobile cleaning robot of claim 16, wherein the one or more gear assemblies includes a timing mechanism to move the pair of wheel stops when the pad assembly is at a desired position.

18. The mobile cleaning robot of claim 17, wherein the timing mechanism is configured to begin moving the pair of wheel stops when or after the pad assembly engages a floor surface.

19. The mobile cleaning robot of claim 17, wherein the timing mechanism is a Geneva mechanism.

20. The mobile cleaning robot of claim 12, further comprising:

a pair Geneva gears connected to the drive system and selectively engageable with the pair of wheel stops to move the pair of wheel stops between the stop position and the release position.

* * * * *